US011189942B2

(12) United States Patent
Wu et al.

(10) Patent No.: US 11,189,942 B2
(45) Date of Patent: Nov. 30, 2021

(54) WIRE PLUG-IN AID SLEEVE STRUCTURE FOR WIRE CONNECTION TERMINAL

(71) Applicants: SWITCHLAB INC., New Taipei (TW); SWITCHLAB (SHANGHAI) CO., LTD., Shanghai (CN); GAOCHENG ELECTRONICS CO., LTD., Shenzhen (CN)

(72) Inventors: Chih-Yuan Wu, New Taipei (TW); Wen Bing Hsu, New Taipei (TW)

(73) Assignees: Switchlab Inc., New Taipei (TW); Switchlab (Shanghai) Co., Ltd., Shanghai (CN); Gaocheng Electronics Co., Ltd., Guangdong (CN)

( * ) Notice: Subject to any disclaimer, the term of this patent is extended or adjusted under 35 U.S.C. 154(b) by 0 days.

(21) Appl. No.: 16/732,484

(22) Filed: Jan. 2, 2020

(65) Prior Publication Data

US 2020/0220284 A1 Jul. 9, 2020

(30) Foreign Application Priority Data

Jan. 4, 2019 (TW) ..... 108100359

(51) Int. Cl.
*H01R 9/24* (2006.01)

(52) U.S. Cl.
CPC ..... *H01R 9/2475* (2013.01); *H01R 9/2416* (2013.01)

(58) Field of Classification Search
CPC ..... H01R 9/2475; H01R 9/2416; H01R 9/24; H01R 9/22; H01R 9/2408; H01R 9/11; H01R 9/15
USPC ..... 439/491
See application file for complete search history.

(56) References Cited

U.S. PATENT DOCUMENTS 4,341,430 A * 7/1982 Crawford ..... H01R 12/675 439/409
5,398,295 A * 3/1995 Chang ..... G02B 6/3879 385/136
5,667,402 A * 9/1997 Denovich ..... H01R 4/2433 439/409
6,152,760 A * 11/2000 Reeser ..... H01R 4/2433 439/395
6,254,421 B1 * 7/2001 Denovich ..... H01R 4/2433 439/409
6,561,838 B1 * 5/2003 Blichfeldt ..... H01R 13/6463 439/418
6,806,424 B2 * 10/2004 Gerving ..... H01R 4/34 174/135

(Continued)

*Primary Examiner* — Harshad C Patel
(74) *Attorney, Agent, or Firm* — Rosenberg, Klein & Lee

(57) ABSTRACT

The middle section and the tail section are mounted in a wire inlet of a terminal device. The aid sleeve is formed with an internal guide hole. A wire collection section is disposed on one side of the head section distal from the middle section. A recessed guide channel is disposed on one side of the wire collection section proximal to the guide hole. The recessed guide channel includes two lateral outer arched channels with larger curvature radius. The two lateral outer arched channels gradually extend toward a middle bottom face to form an inner arched channel with smaller curvature radius. The recessed guide channel can gradually bind the forked conductor end section of a multi-strand conductive wire, whereby the wire can be quickly plugged into the guide hole.

36 Claims, 16 Drawing Sheets

(56) References Cited

U.S. PATENT DOCUMENTS

| | | | | |
|---|---|---|---|---|
| 7,260,156 | B2 * | 8/2007 | Krupezevic | H04B 1/16 327/291 |
| 7,901,240 | B2 * | 3/2011 | Jackson | H01R 4/5025 439/465 |
| 10,598,880 | B2 * | 3/2020 | Mullaney | G02B 6/383 |
| 2008/0311796 | A1 * | 12/2008 | Washburn | G01R 1/0416 439/669 |
| 2016/0219740 | A1 * | 7/2016 | Gehrke | H05K 7/026 |
| 2018/0175516 | A1 * | 6/2018 | Wu | H01R 12/515 |
| 2018/0337472 | A1 * | 11/2018 | Wu | H01R 4/4827 |

* cited by examiner

WIRE PLUG-IN AID SLEEVE STRUCTURE FOR WIRE CONNECTION TERMINAL

BACKGROUND OF THE INVENTION

1. Field of the Invention

The present invention relates generally to a wire plug-in aid sleeve structure for wire connection terminal, and more particularly to an aid sleeve structure, which can conveniently bind the forked end section of a multi-strand conductive wire, whereby the wire can be easily plugged into the wire inlet of the terminal and assembled therewith.

2. Description of the Related Art

In a conventional switch mechanism or wire connection terminal mechanism, in order to permit different diameters of conductive wires to plug into and connect with the terminal, the wire inlet of the terminal is generally designed with a diameter obviously larger than the diameter of the conductive wire. Accordingly, in practice, an operator can conveniently plug the conductive wire into the terminal. However, in actual application, the above design has the following shortcomings:

1. The diameter of the wire inlet is obviously larger than the diameter of the conductive wire. As a result, the external dust and water is apt to intrude and accumulate in the terminal to affect the electro-conductive performance between the terminal and the conductive wire.
2. The diameter of the wire inlet is obviously larger than the diameter of the conductive wire. Therefore, after the conductive wire is plugged into wire inlet, there is a larger space for the conductive wire to deflect. Therefore, the conductive wire is apt to deflect or swing due to external force. This will lead to poor contact and insecurity.

In order to improve the shortcomings, FIGS. 1 and 2 show an aid sleeve structure 7, which enables a conductive wire with obviously smaller diameter to be applied to a wire inlet with a larger diameter. The aid sleeve 7 has a head section 71 and a tail section 73 respectively at two ends and a middle section 72 positioned between the head section 71 and the tail section 73. The head section 71, the middle section 72 and the tail section 73 together define a guide hole 75 for a conductive wire to plug in. In use, the middle section 72 and the tail section 73 of the aid sleeve 7 are plugged into the wire inlet 81 of a terminal device 8, (which can be a switch or a wire connection terminal). An external (multi-strand) conductive wire 9 is guided by the guide hole 75 of the aid sleeve 7 to extend into the wire inlet 81 so as to electrically connect with a contact inside the wire inlet 81. The aid sleeve can improve the shortcoming of the conventional terminal that when a (multi-strand) conductive wire 9 with smaller diameter is extended into a wire inlet 81 with a larger diameter, the conductive wire 9 is apt to deflect or swing.

However, in the application situation that the multi-strand conductive wire 9 is used for wiring, when the external insulation skin of the multi-strand conductive wire 9 is removed, the conductor end section 91 of the multi-strand conductive wire 9 is apt to spread into a forked state and hard to plug into the guide hole 75 (as shown in FIG. 2). Therefore, in practice, it is necessary for an operator to first hold the multi-strand conductive wire 9 with one hand and then bind and collect the forked conductor end section 91 of the multi-strand conductive wire 9 with the other hand (or a tool) so as to successfully plug the multi-strand conductive wire 9 into the guide hole 75. Therefore, it is more troublesome and time-consuming in operation.

It is therefore tried by the applicant to provide a wire plug-in aid sleeve structure for wire connection terminal to improve the shortcomings of the conventional aid sleeve structure.

SUMMARY OF THE INVENTION

It is therefore a primary object of the present invention to provide a wire plug-in aid sleeve structure for wire connection terminal. The aid sleeve structure has a guide hole and a wire collection section disposed on one side of one end of the guide hole to protrude therefrom. A recessed guide channel is disposed on one side of the wire collection section proximal to the guide hole. The recessed guide channel includes two lateral outer arched channels with larger curvature radius. The two lateral outer arched channels gradually extend toward a middle bottom face to form an inner arched channel with smaller curvature radius. The recessed guide channel can gradually bind the forked conductor end section of a multi-strand conductive wire from outer side to inner side, whereby the wire can be easily plugged into the guide hole. Accordingly, the plug-in operation of the multi-strand conductive wire is effectively simplified to enhance the operation efficiency.

It is a further object of the present invention to provide the above wire plug-in aid sleeve structure for wire connection terminal, in which a display face is directly formed on one side of the wire collection section distal from the recessed guide channel. A character encoding assembly having a character code is disposed on the display face. Accordingly, the corresponding guide holes and the conductive wires can be marked to enhance the recognition effect as a whole.

It is still a further object of the present invention to provide the above wire plug-in aid sleeve structure for wire connection terminal, in which a side wing section is transversely disposed on one side of the aid sleeve proximal to the wire collection section. A display face is formed on at least one side of the side wing section. A character encoding assembly having a character code is disposed on the display face so as to form a mark form different from the aforesaid display face, on which the character encoding assembly is disposed. Accordingly, a different recognition effect is achieved.

To achieve the above and other objects, the wire plug-in aid sleeve structure for wire connection terminal of the present invention includes at least one aid sleeve assembly composed of at least one aid sleeve. The aid sleeve is formed with an internal guide hole passing through the aid sleeve. The aid sleeve has a wire collection section protruding from one side of one end of the guide hole. A recessed guide channel is disposed on one side of the wire collection section proximal to the guide hole. The recessed guide channel communicates with the guide hole.

In the above wire plug-in aid sleeve structure for wire connection terminal, the recessed guide channel includes two lateral outer arched channels with larger curvature radius. The two lateral outer arched channels gradually extend toward a middle bottom face to form an inner arched channel with smaller curvature radius.

In the above wire plug-in aid sleeve structure for wire connection terminal, the aid sleeve has a head section and a tail section at two ends and a middle section connected between the head section and the tail section. The guide hole is tapered at the junction between the middle section and the tail section. The tail section protrudes from the middle section. The middle section has a cross-sectional area larger than that of the tail section. The tail section has two lateral sides positioned on a periphery of the guide hole. The two lateral sides define therebetween a notch. The aid sleeve assembly is composed of multiple aid sleeves, which are side by side arranged. The head sections of the aid sleeves are connected to form the aid sleeve assembly.

In the above wire plug-in aid sleeve structure for wire connection terminal, a depression section is formed at one end of the wire collection section distal from the guide hole.

In the above wire plug-in aid sleeve structure for wire connection terminal, a display face with a character encoding assembly is disposed on one side of the wire collection section distal from the recessed guide channel. The character encoding assembly is a character code directly stamped on the display face.

In the above wire plug-in aid sleeve structure for wire connection terminal, a display face with a character encoding assembly is disposed on one side of the wire collection section distal from the recessed guide channel. Two opposite sides of the display face are respectively formed with a slide channel. The character encoding assembly is a display plate stamped with a character code. Two lateral sides of the display plate are respectively extended into the slide channels to locate therein.

In the above wire plug-in aid sleeve structure for wire connection terminal, there are at least two aid sleeve assemblies. A connection section is disposed between the aid sleeve assemblies. The connection section is connected between the head sections of the aid sleeves of the aid sleeve assemblies.

In the above wire plug-in aid sleeve structure for wire connection terminal, one side of the head section is formed with a notch proximal to the middle section. The head section has a lateral protrusion transversely protruding from the head section. One side of the lateral protrusion proximal to the middle section is formed with a lower slope.

In the above wire plug-in aid sleeve structure for wire connection terminal, at least one side wing section is transversely disposed on one side of the head section. A display face with a character encoding assembly is disposed on at least one side of the side wing section. The character encoding assembly is a character code directly stamped on the display face.

In the above wire plug-in aid sleeve structure for wire connection terminal, at least one side wing section is transversely disposed on one side of the head section. A display face with a character encoding assembly is disposed on at least one side of the side wing section. Two opposite sides of the display face being respectively formed with a slide channel. The character encoding assembly is a display plate having a character code. Two lateral sides of the display plate are respectively extended into the slide channels to locate therein.

The present invention can be best understood through the following description and accompanying drawings, wherein:

DETAILED DESCRIPTION OF THE PREFERRED EMBODIMENTS

Figure 2:
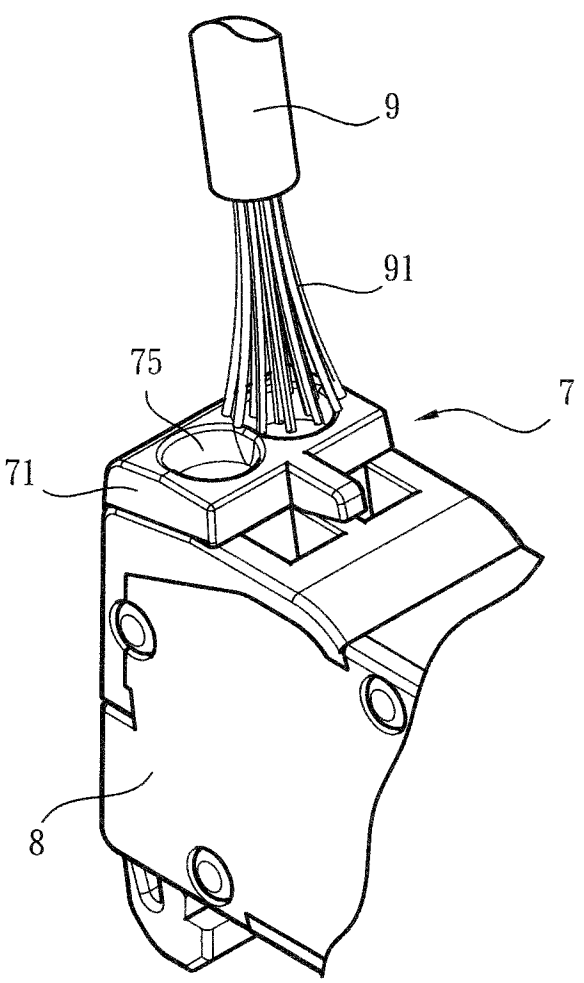
Fig. 2 PRIOR ART
FIG. 2 is a perspective view showing that the conductor end section of the conventional multi-strand conductive wire is forked and uneasy to plug into the guide hole of the conventional aid sleeve.
Figure 1:
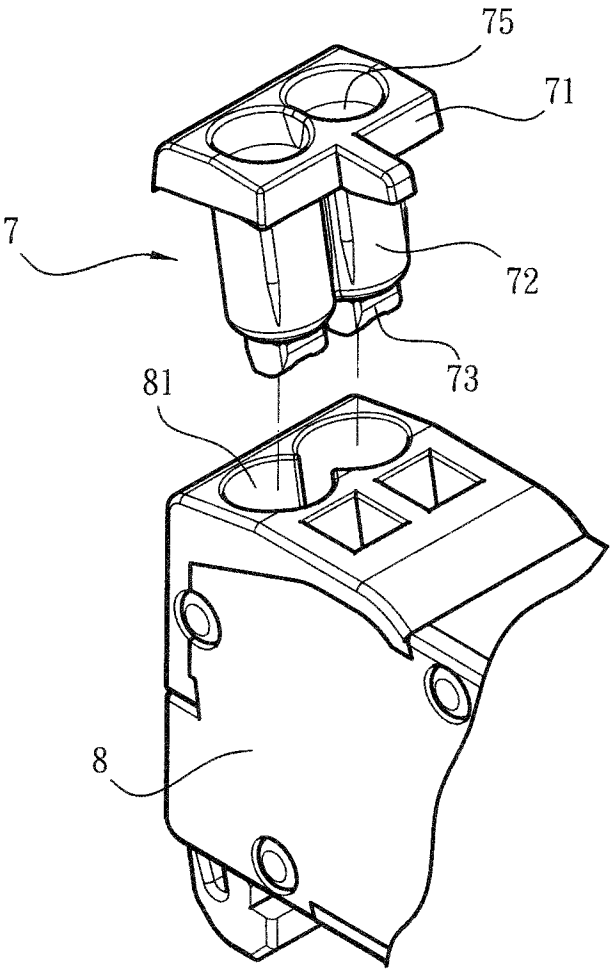
Fig. 1 PRIOR ART
FIG. 1 is a perspective view of the structure of a conventional aid sleeve, showing the position of the aid sleeve before the aid sleeve is assembled with a terminal device.
Figure 4:
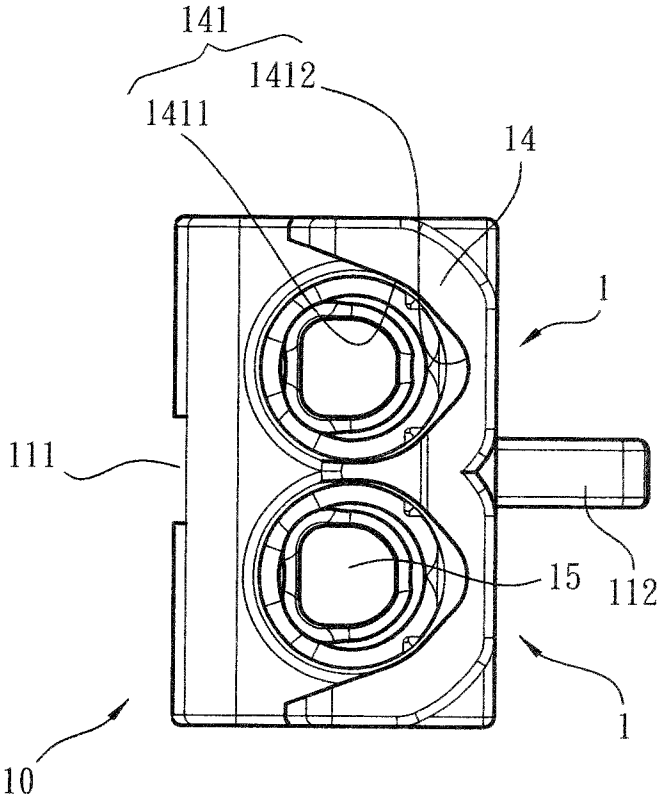
FIG. 4 is a top view of the first embodiment of the present invention.
Figure 3:
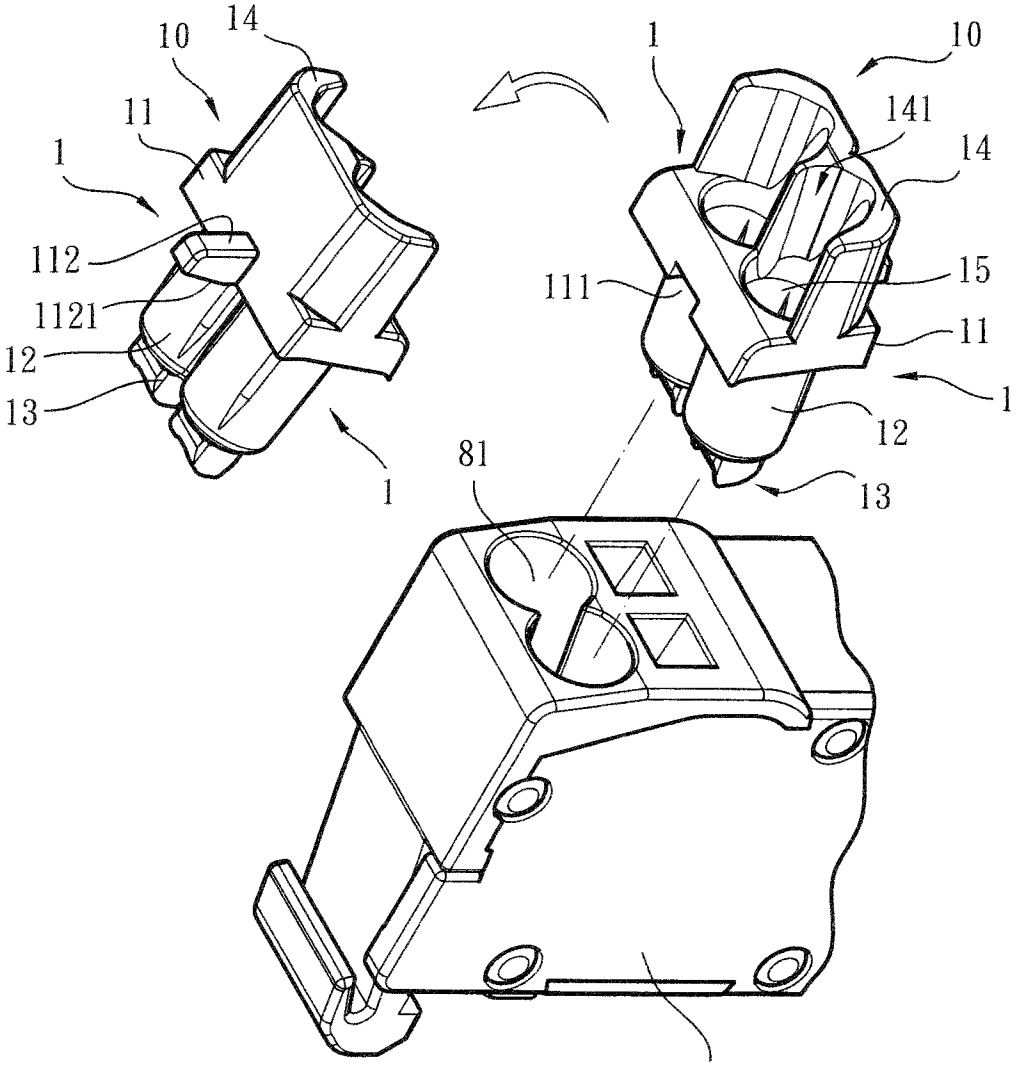
FIG. 3 is a perspective view of a first embodiment of the present invention, showing the structure of the aid sleeve before the aid sleeve is assembled with a terminal device.

Please refer to FIGS. 3 to 7. According to a first embodiment, the wire plug-in aid sleeve structure for wire connection terminal of the present invention includes at least one aid sleeve 1 made of rubber, plastic or the like material. The aid sleeve 1 is formed with an internal guide hole 15 passing through the aid sleeve 1. In addition, the aid sleeve 1 has a wire collection section 14 protruding from one side of one end of the guide hole 15. A recessed guide channel 141 is disposed on one side of the wire collection section 14 proximal to the guide hole 15. The recessed guide channel 141 communicates with the guide hole 15.

The aid sleeve 1 has a head section 11 and a tail section 13 at two ends and a middle section 12 connected between the head section 11 and the tail section 13. An outer periphery of the head section 11 laterally expands, whereby the head section 11 has a cross-sectional area larger than that of the middle section 12. The tail section 13 protrudes from the middle section 12. The middle section 12 has a cross-sectional area larger than that of the tail section 13. The tail section 13 has two lateral sides 131 positioned on the periphery of the guide hole 15. The two lateral sides 131 define therebetween a notch 132. The guide hole 15 is tapered at the junction between the middle section 12 and the tail section 13.

In a preferred embodiment, the recessed guide channel 141 includes two lateral outer arched channels 1411 with larger curvature radius. The two lateral outer arched channels 1411 gradually extend toward the middle bottom face to form an inner arched channel 1412 with smaller curvature radius. Accordingly, the recessed guide channel 141 forms a structure capable of binding the forked conductor end section 91 of a multi-strand conductive wire 9.

In practice, one side of the aid sleeve 1 with the recessed guide channel 141 is directed to two lateral sides of a preset terminal device 8 (such as a switch or wire connection terminal). The tail section 13 and the middle section 12 are mounted in the wire inlet 81 of the terminal device 8. The head section 11 is pressed to cover the wire inlet 81 and locate. In this embodiment, each side of the terminal device 8 has two wire inlets 81. Therefore, two aid sleeves 1 can be arranged side by side with the head sections 11 connected to form an aid sleeve assembly 10. Alternatively, in other application situation, the aid sleeve 1 can be a separate member. Alternatively, the aid sleeve assembly 10 can be composed of more than two aid sleeves 1.

Figure 6:
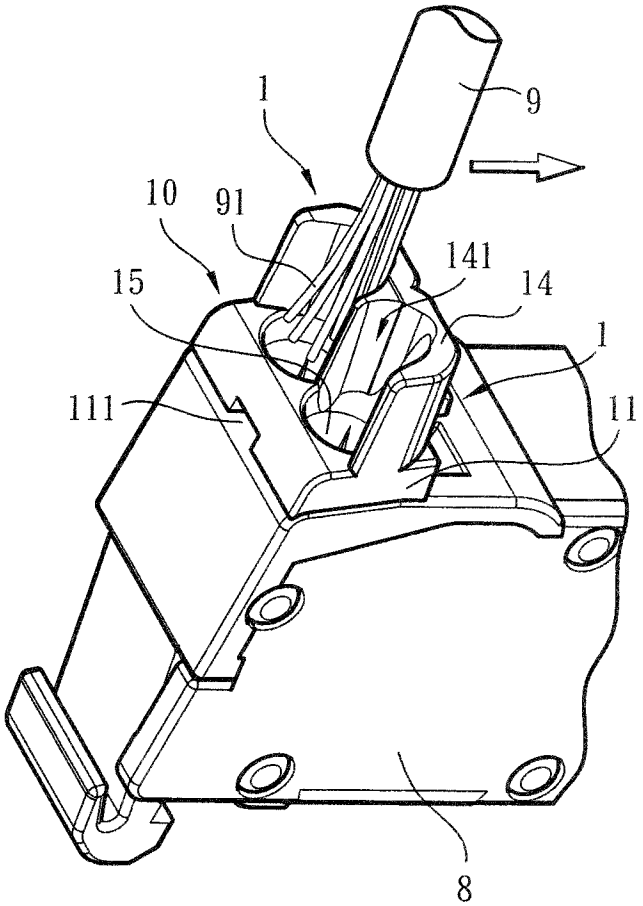
FIG. 6 is a perspective view of the first embodiment of the present invention, showing that a multi-strand conductive wire is to be plugged into the guide hole.
Figure 5:
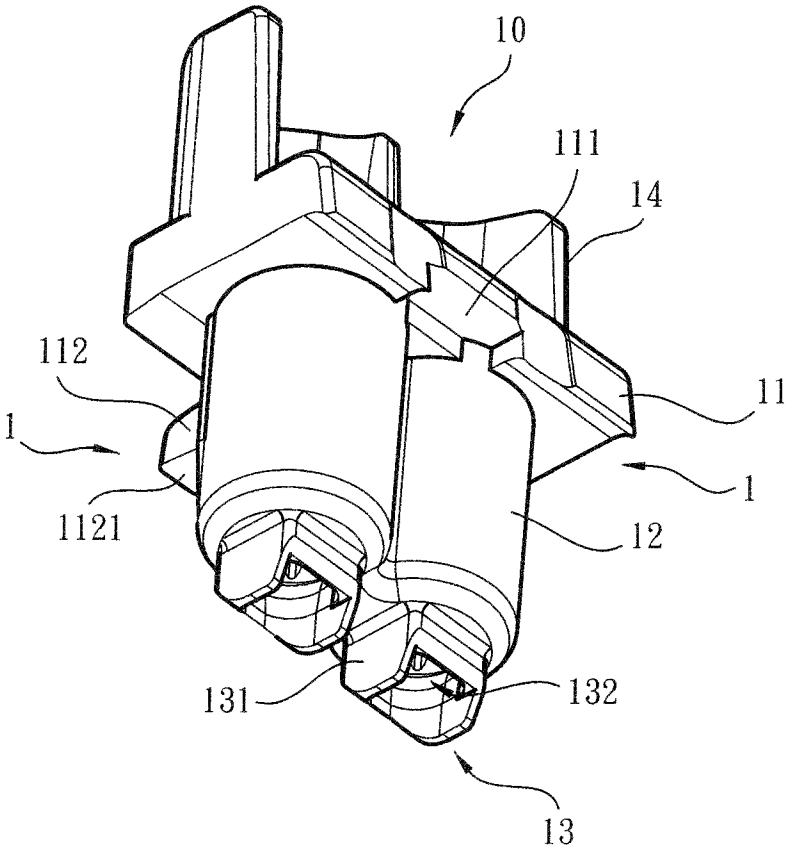
FIG. 5 is a perspective view showing the structure of the tail section of the first embodiment of the present invention.
Figure 7:
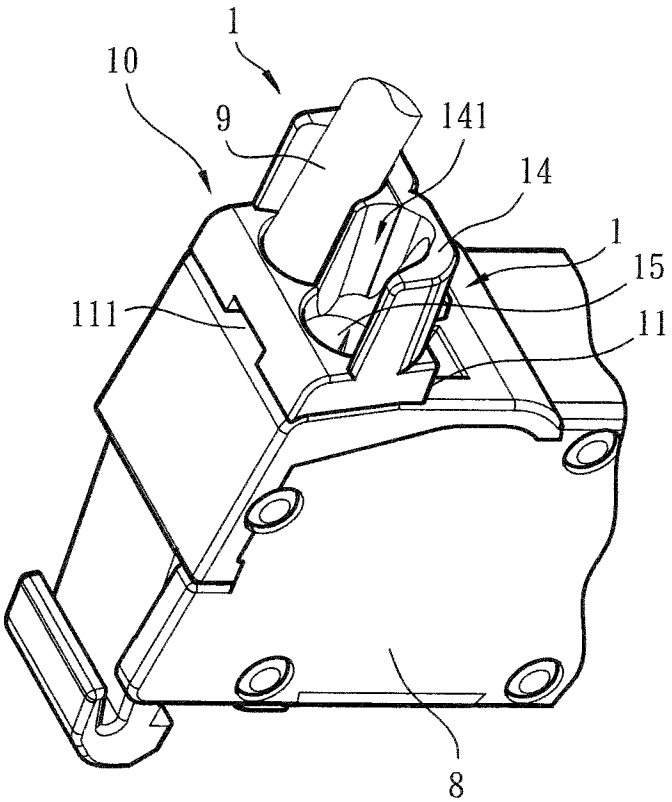
FIG. 7 is a perspective view of the first embodiment of the present invention, showing that the multi-strand conductive wire is plugged into the guide hole.

In use, the forked conductor end section 91 of the multi-strand conductive wire 9 can be transversely extended into the recessed guide channel 141 of the wire collection section 14. The outer arched channels 1411 serve to gradually guide the forked conductor end section 91 to the inner arched channel 1412 into a bound state (as shown in FIG. 6). Then the multi-strand conductive wire 9 is pushed into the guide hole 15. As aforesaid, the guide hole 15 is tapered at the junction between the middle section 12 and the tail section 13, whereby the conductor end section 91 can be guided and plugged into the wire inlet 81 of the terminal device 8 (as shown in FIG. 7) to electrically connect with an electro-conductive member (not shown) preset in the terminal device 8.

In the above structure, the head section 11 has a transversely protruding lateral protrusion 112 directed to the middle of the terminal device 8. One side of the lateral protrusion 112 proximal to the middle section 12 is formed with a lower slope 1121. The lower slope 1121 makes a gap formed between the lateral protrusion 112 and the surface of the lateral side of the wire inlet 81 of the terminal device 8. Accordingly, a tool (such as a screwdriver) can be inserted into the gap to pry up the aid sleeve 1 and separate the aid sleeve 1 from the wire inlet 81 of the terminal device 8. Also, one side of the head section 11 distal from the lateral protrusion 112 is formed with a notch 111 proximal to the middle section 12. A tool (such as a screwdriver) can be inserted into the notch 111 to pry up the aid sleeve 1 and separate the aid sleeve 1 from the wire inlet 81 of the terminal device 8.

Figure 8:
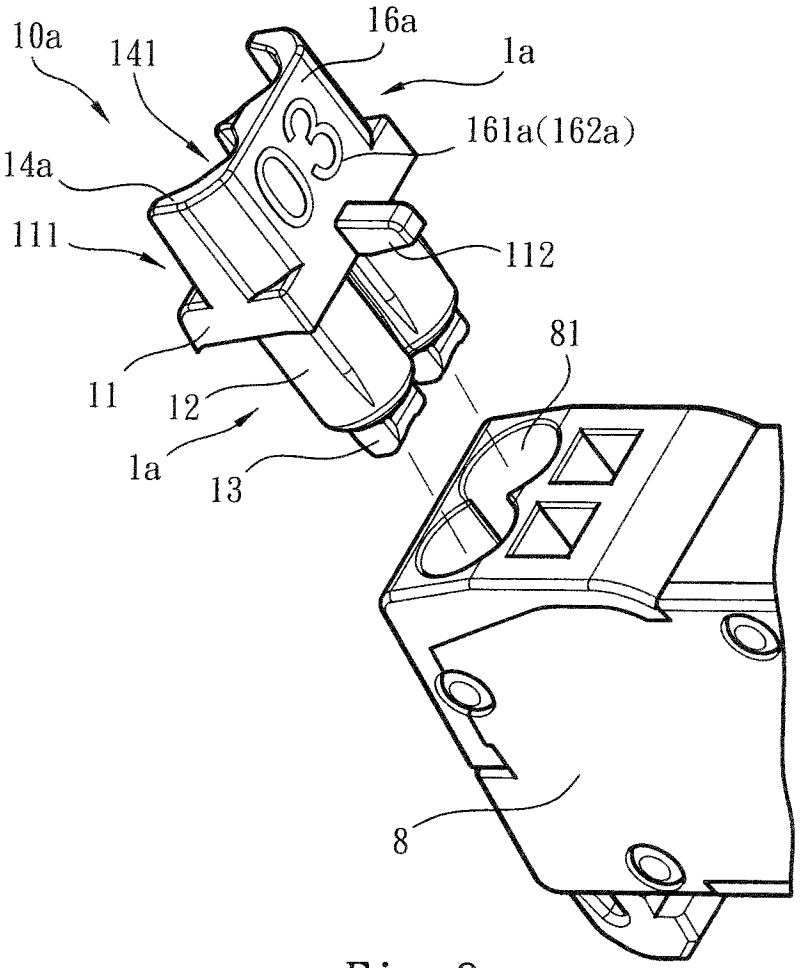
FIG. 8 is a perspective view of a second embodiment of the present invention, showing the structure of the aid sleeve before the aid sleeve is assembled with a terminal device.

Please now refer to FIG. 8. According to a second embodiment, the wire plug-in aid sleeve structure for wire connection terminal of the present invention includes at least one aid sleeve 1*a*. The aid sleeve 1*a* has a wire collection section 14*a* and a head section 11, a middle section 12, a tail section 13 and a guide hole 15 identical to those of the first embodiment. The wire collection section 14*a* has a recessed guide channel 141 similar to that of the wire collection section 14. Also, the wire collection section 14*a* is disposed on the head section 11 in the same manner as the wire collection section 14. The wire collection section 14*a* is simply different from the wire collection section 14 in that a display face 16*a* with a character encoding assembly 161*a* is disposed on one side of the wire collection section 14*a* distal from the recessed guide channel 141 (the guide hole 15).

In this embodiment, two aid sleeves 1*a* are assembled with each other to form an aid sleeve assembly 10*a* in the same manner as the first embodiment. The display face 16*a* is together disposed on one side of the two wire collection sections 14*a* distal from the recessed guide channel 141 (the guide hole 15). The character encoding assembly 161*a* is a character code 162*a* directly stamped on the display face 16*a*.

Figure 10:
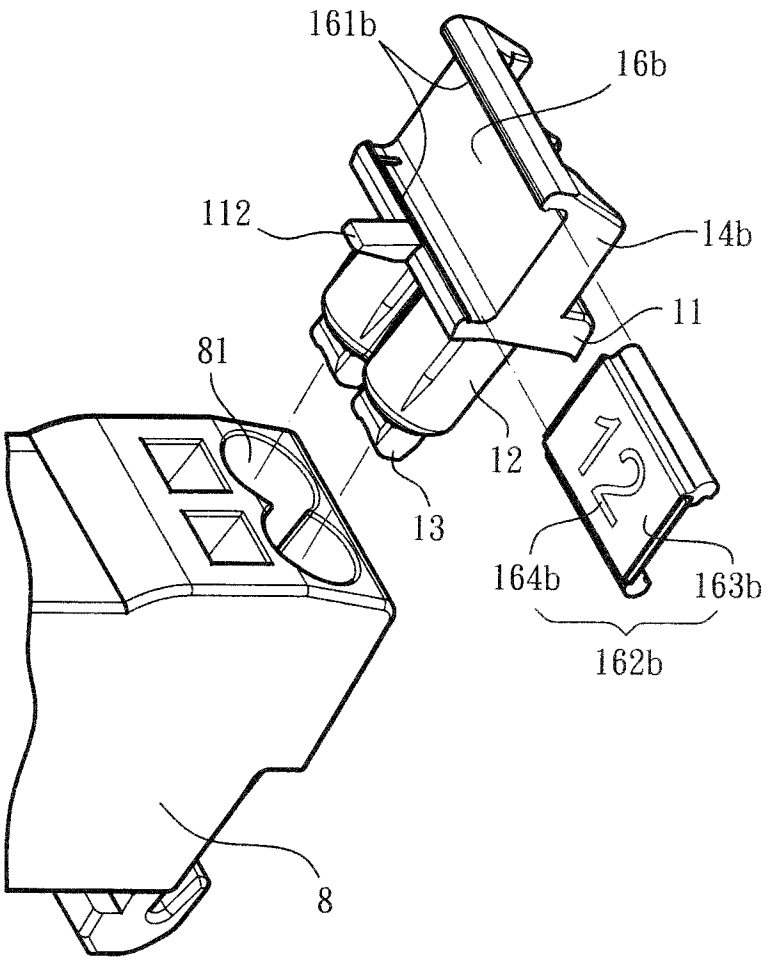
FIG. 10 is a perspective view according to FIG. 9, seen from the other side.
Figure 9:
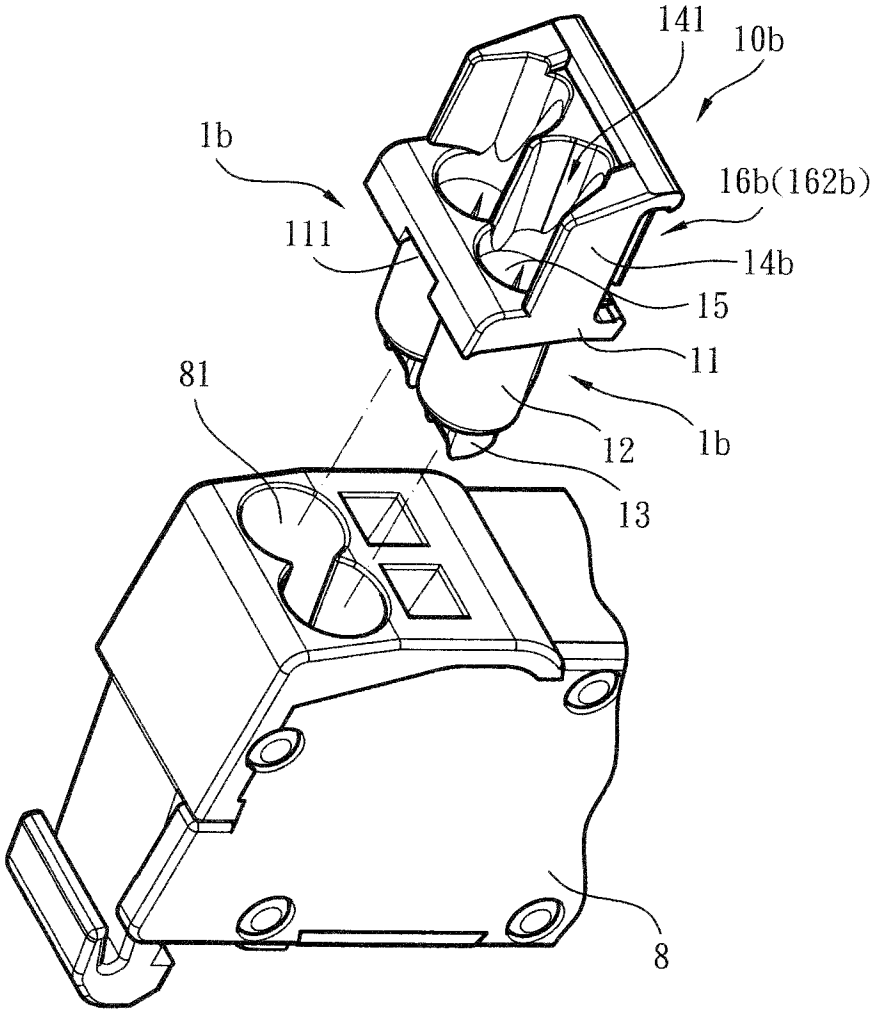
FIG. 9 is a perspective view of a third embodiment of the present invention, showing the structure of the aid sleeve before the aid sleeve is assembled with a terminal device.
Figure 11:
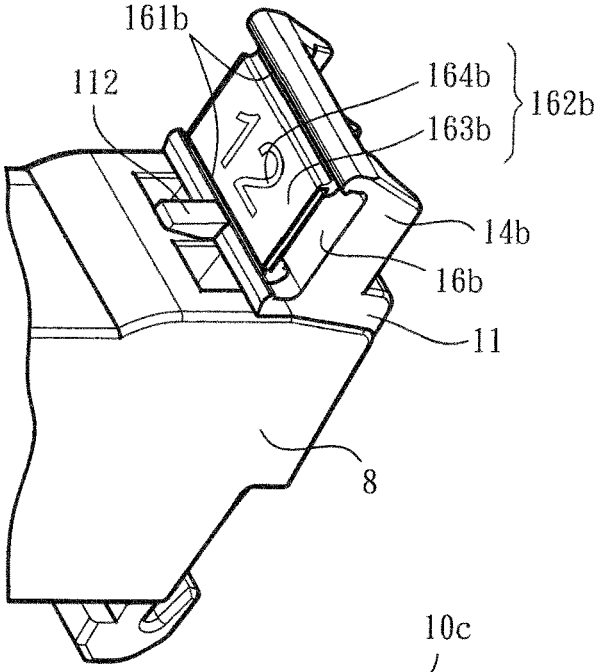
FIG. 11 is a perspective assembled view according to FIG. 10.

Please now refer to FIGS. 9 to 11. According to a third embodiment, the wire plug-in aid sleeve structure for wire connection terminal of the present invention includes at least one aid sleeve 1*b*. The aid sleeve 1*b* has a wire collection section 14*b* and a head section 11, a middle section 12, a tail section 13 and a guide hole 15 identical to those of the first embodiment. The wire collection section 14*b* has a recessed guide channel 141 similar to that of the wire collection section 14. Also, the wire collection section 14*b* is disposed on the head section 11 in the manner as the wire collection section 14. The wire collection section 14*b* is simply different from the wire collection section 14 in that a display face 16*b* is disposed on one side of the wire collection section 14*b* distal from the recessed guide channel 141 (the guide hole 15). The display face 16*b* can be assembled with a character encoding assembly 162*b*.

In this embodiment, two aid sleeves 1*b* are assembled with each other to form an aid sleeve assembly 10*b* in the same manner as the first embodiment. The display face 16*b* is together disposed on one side of the two wire collection sections 14*b* distal from the recessed guide channel 141 (the guide hole 15). Two opposite sides of the display face 16*b* are respectively formed with a slide channel 161*b*. The character encoding assembly 162*b* is a display plate 163*b* stamped with a character code 164*b*. Two lateral sides of the display plate 163*b* can be respectively extended into the slide channels 161*b* to locate therein, whereby a replaceable encoding structure is formed in accordance with different use requirements and change.

Figure 12:
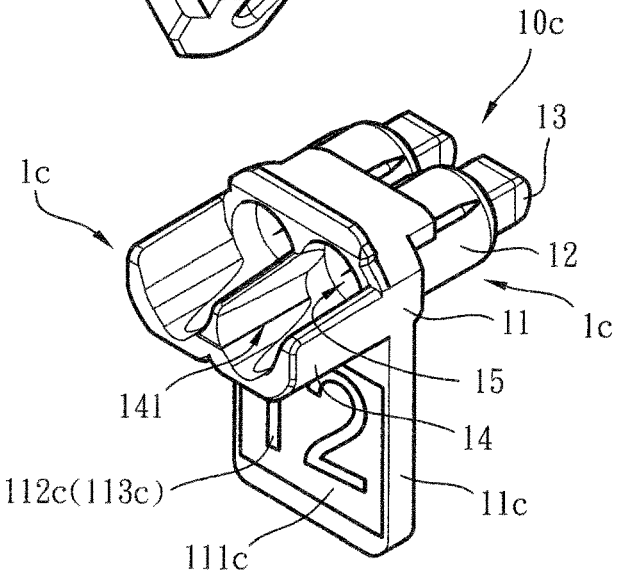
FIG. 12 is a perspective view of a fourth embodiment of the present invention.

Please now refer to FIG. 12. According to a fourth embodiment, the wire plug-in aid sleeve structure for wire connection terminal of the present invention includes at least one aid sleeve 1*c*. The aid sleeve 1*c* has a head section 11, a middle section 12, a tail section 13, a wire collection section 14 and a guide hole 15 identical to those of the first embodiment. The fourth embodiment is simply different from the first embodiment in that a side wing section 11*c* is transversely disposed on one side of the head section 11 distal from the recessed guide channel 141 (the guide hole 15). A display face 111*c* with a character encoding assembly 112*c* is disposed on one side of the side wing section 11*c*.

In this embodiment, two aid sleeves 1*c* are assembled with each other to form an aid sleeve assembly 10*c* in the same manner as the first embodiment. The side wing section 11*c* is together disposed on one side of the two wire collection sections 14*c* distal from the recessed guide channel 141 (the guide hole 15). The character encoding assembly 112*c* is a character code 113*c* directly stamped on the display face 111*c*.

Figure 13:
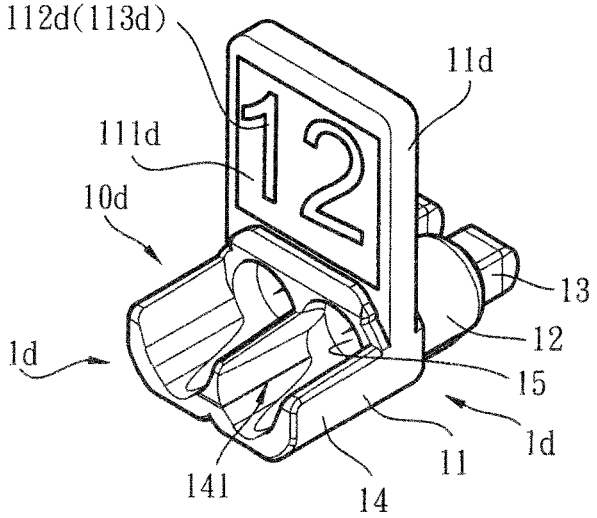
FIG. 13 is a perspective view of a fifth embodiment of the present invention.

Please now refer to FIG. 13. According to a fifth embodiment, the wire plug-in aid sleeve structure for wire connection terminal of the present invention includes at least one aid sleeve 1*d*. The aid sleeve 1*d* has a head section 11, a middle section 12, a tail section 13, a wire collection section 14 and a guide hole 15 identical to those of the first embodiment. The fifth embodiment is simply different from the first embodiment in that a side wing section 11*c* is transversely disposed on one side of the head section 11 proximal to the recessed guide channel 141 (the guide hole 15). A display face 111*d* with a character encoding assembly 112*d* is disposed on one side of the side wing section 11*d*.

In this embodiment, two aid sleeves 1*d* are assembled with each other to form an aid sleeve assembly 10*d* in the same manner as the first embodiment. The side wing section 11*d* is together disposed on one side of the two head sections 11 proximal to the recessed guide channel 141 (the guide hole 15). The character encoding assembly 112*d* is a character code 113*d* directly stamped on the display face 111*d*.

Figure 14:
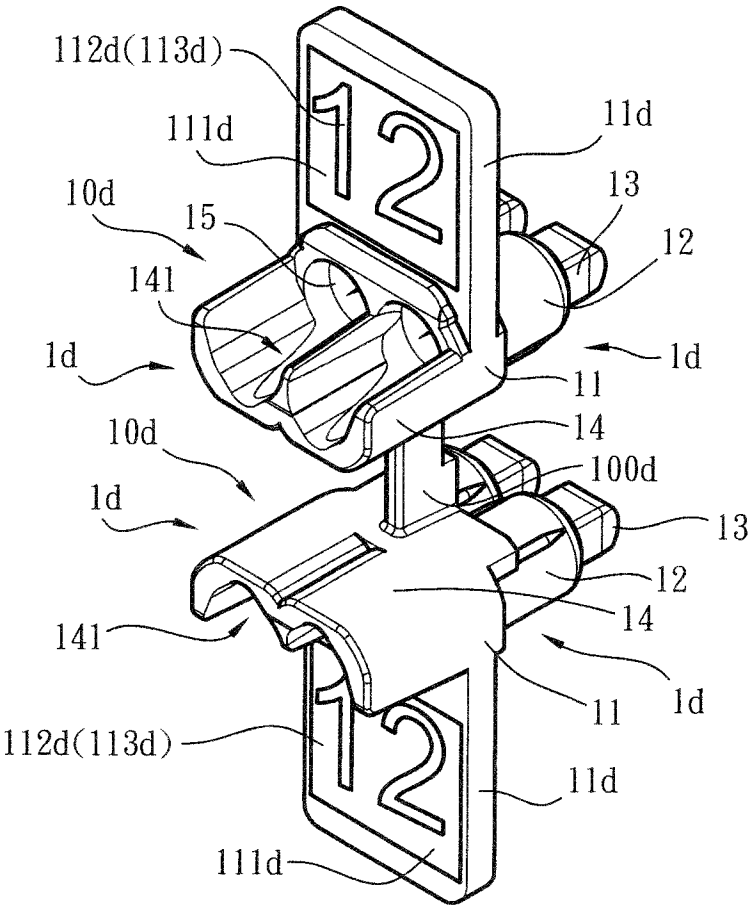
FIG. 14 is a perspective view of a sixth embodiment of the present invention.

Please now refer to FIG. 14. According to a sixth embodiment, the wire plug-in aid sleeve structure for wire connection terminal of the present invention includes two aid sleeve assemblies 10*d*, which are side by side arranged. One side of one of the aid sleeve assemblies 10*d* distal from the recessed guide channel 141 (the guide hole 15) is opposite to one side of the other of the aid sleeve assemblies 10*d* distal from the recessed guide channel 141 (the guide hole 15). A connection section 100*d* is connected between the head sections 11 of the two aid sleeve assemblies 10*d*, whereby the two aid sleeve assemblies 10*d* are integrally connected with each other via the connection section 100*d*.

In practice, a structure similar to the connection section 100*d* can be used to integrally connect the two aid sleeve assemblies 10*c* of the fourth embodiment as shown in FIG. 12 in the same manner.

Figure 15:
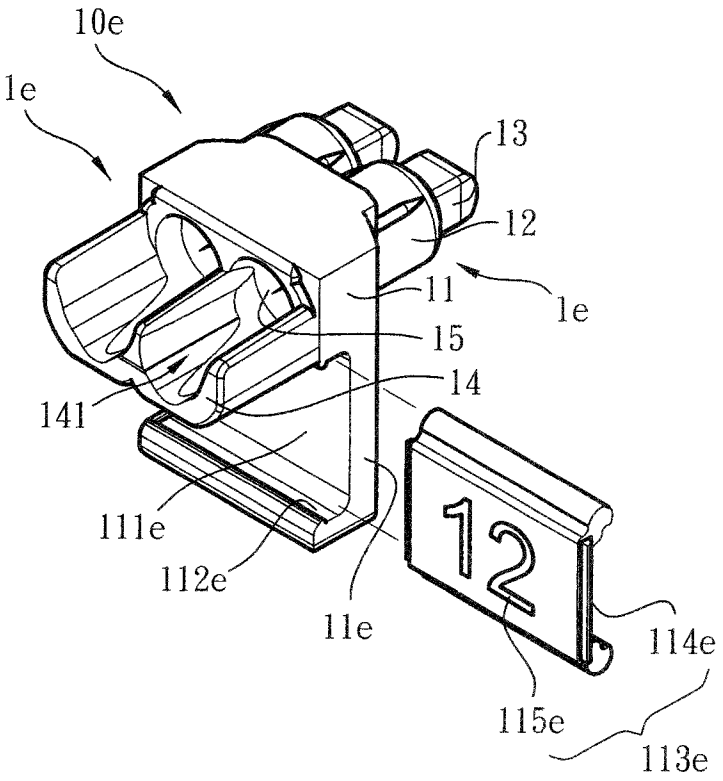
FIG. 15 is a perspective exploded view of a seventh embodiment of the present invention.

Please now refer to FIG. 15. According to a seventh embodiment, the wire plug-in aid sleeve structure for wire connection terminal of the present invention includes at least one aid sleeve 1*e*. The aid sleeve 1*e* has a head section 11, a middle section 12, a tail section 13, a wire collection section 14 and a guide hole 15 identical to those of the first embodiment. The fifth embodiment is simply different from the first embodiment in that a side wing section lie is transversely disposed on one side of the head section 11 distal from the recessed guide channel 141 (the guide hole 15). A display face 111*e* with a character encoding assembly 113*e* is disposed on one side of the side wing section lie.

In this embodiment, two aid sleeves 1*e* are assembled with each other to form an aid sleeve assembly 10*e* in the same manner as the first embodiment. The side wing section lie is together disposed on one side of the two head sections 11 distal from the recessed guide channel 141 (the guide hole 15). Two opposite sides of the display face 111*e* are respectively formed with slide channel 112*e*. The character encoding assembly 113*e* is a display plate 114*e* stamped with a character code 115*e*. Two lateral sides of the display plate 114*e* can be respectively extended into the slide channels 112*e* to locate therein, whereby a replaceable encoding structure is formed.

Figure 16:
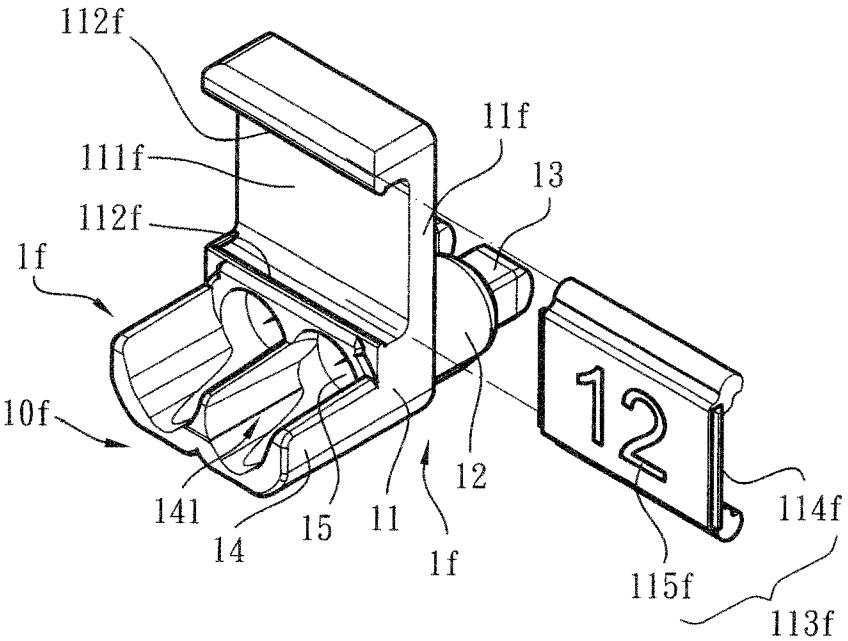
FIG. 16 is a perspective exploded view of an eighth embodiment of the present invention.

Please now refer to FIG. 16. According to an eighth embodiment, the wire plug-in aid sleeve structure for wire connection terminal of the present invention includes at least one aid sleeve 1*f*. The aid sleeve 1*f* has a head section 11, a middle section 12, a tail section 13, a wire collection section 14 and a guide hole 15 identical to those of the first embodiment. The eighth embodiment is simply different from the first embodiment in that a side wing section 11*f* is transversely disposed on one side of the head section 11 proximal to the recessed guide channel 141 (the guide hole 15). A display face 111*f* with a character encoding assembly 113*f* is disposed on one side of the side wing section lie.

In this embodiment, two aid sleeves 1*f* are assembled with each other to form an aid sleeve assembly 10*f* in the same manner as the first embodiment. The side wing section 11*f* is together disposed on one side of the two head sections 11 proximal to the recessed guide channel 141 (the guide hole 15). Two opposite sides of the display face 111*f* are respectively formed with slide channel 112*f*. The character encoding assembly 113*f* is a display plate 114*f* stamped with a character code 115*f*. Two lateral sides of the display plate 114*f* can be respectively extended into the slide channels 112*f* to locate therein, whereby a replaceable encoding structure is formed.

Figure 17:
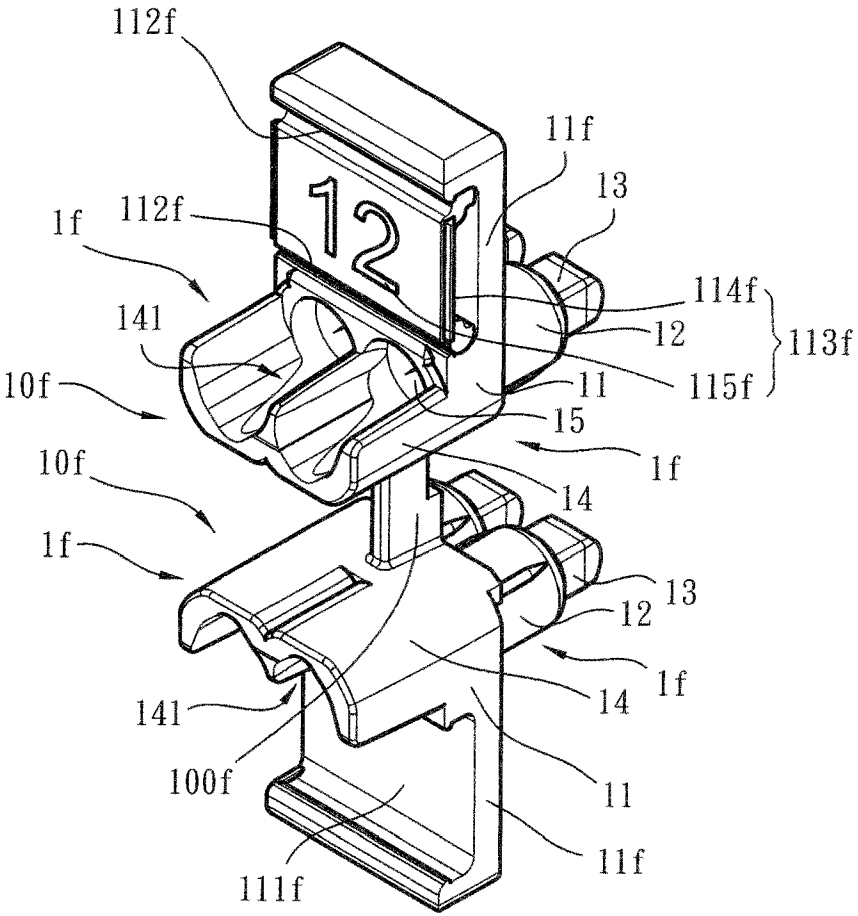
FIG. 17 is a perspective view of a ninth embodiment of the present invention.
Figure 18:
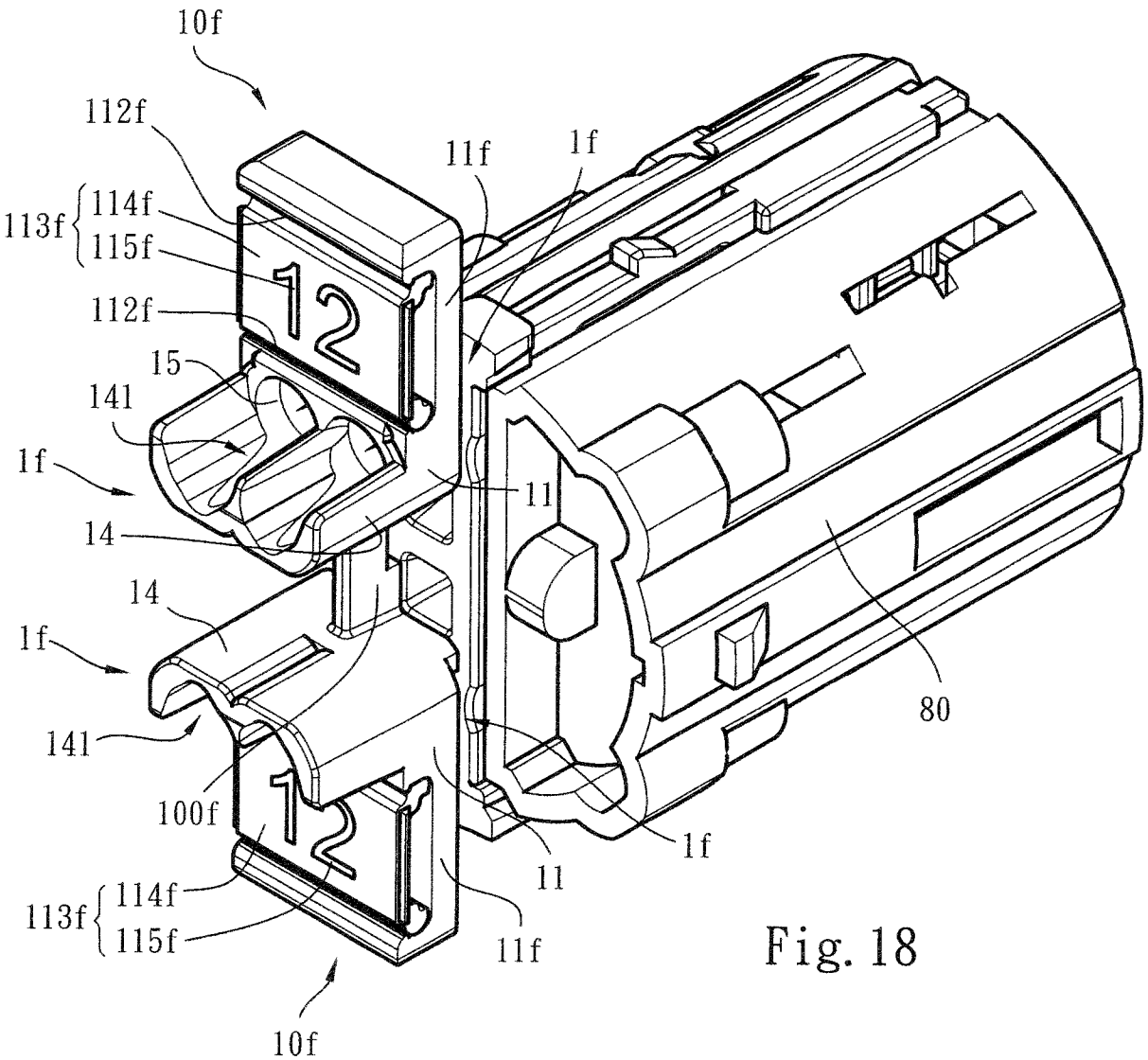
FIG. 18 is a perspective view showing the application of the ninth embodiment of the present invention.

Please now refer to FIGS. 17 and 18. According to a ninth embodiment, the wire plug-in aid sleeve structure for wire connection terminal of the present invention includes two aid sleeve assemblies 10*f*, which are side by side arranged. One side of one of the aid sleeve assemblies 10*f* distal from the recessed guide channel 141 (the guide hole 15) is opposite to one side of the other of the aid sleeve assemblies 10*f* distal from the recessed guide channel 141 (the guide hole 15). A connection section 110*f* is connected between the head sections 11 of the two aid sleeve assemblies 10*f*, whereby the two aid sleeve assemblies 10*f* are integrally connected with each other via the connection section 100*f*. In addition, the aid sleeve assemblies 10*f* can be both mounted in a terminal device 80 having multiple adjacent wire inlets.

In practice, a structure similar to the connection section 100*f* can be used to integrally connect the two aid sleeve assemblies 10*e* of the seventh embodiment as shown in FIG. 15 in the same manner.

Please now refer to FIGS. 19 to 22. According to a tenth embodiment, the wire plug-in aid sleeve structure for wire connection terminal of the present invention includes at least one aid sleeve 2. The aid sleeve 2 has a head section 21, a middle section 22, a tail section 23, a wire collection section 24 and a guide hole 25. The middle section 22 is connected between the head section 21 and the tail section 23. The wire collection section 24 is disposed on one side of the head section 21 distal from the middle section 22. The middle section 22, the tail section 23 and the guide hole 25 have the same structure as the middle section 12, the tail section 13 and the guide hole 15 of the first embodiment. The wire collection section 24 has a recessed guide channel 241 similar to the recessed guide channel 141. In addition, a depression section 242 is formed at one end of the wire collection section 24 distal from the head section 21 (the guide hole 25). In this embodiment, the number of the depression sections 242 is equal to the number of the guide holes 25.

In the above structure, a notch 211 is formed on an edge of one side of the head section 21 directed to the recessed guide channel 241 proximal to the middle section 22. The notch 211 is for a tool to insert to pry up the aid sleeve 2. A lateral protrusion 212 is transversely disposed on one side of the head section 21 distal from the notch 211. One side of the lateral protrusion 212 proximal to the middle section 22 is formed with a lower slope 2121. The lower slope 2121 makes a gap formed between the lateral protrusion 212 and the surface of the lateral side of the wire inlet 81 of the terminal device 8. Accordingly, a tool (such as a screwdriver) can be inserted into the gap to pry up the aid sleeve 2.

In this embodiment, one side of the aid sleeve 2 with the recessed guide channel 241 is directed to two lateral sides of a preset terminal device 8. The tail section 23 and the middle section 22 are mounted in the wire inlet 81 of the terminal device 8. The head section 21 is pressed to cover the wire inlet 81 and locate. In this embodiment, each side of the terminal device 8 has two wire inlets 81. Therefore, the head sections 21 of two aid sleeves 2 can be connected to form an aid sleeve assembly 20. Alternatively, in other application situation, the aid sleeve 2 can be a separate member. Alternatively, the aid sleeve assembly 20 can be composed of more than two aid sleeves 2.

Figure 20:
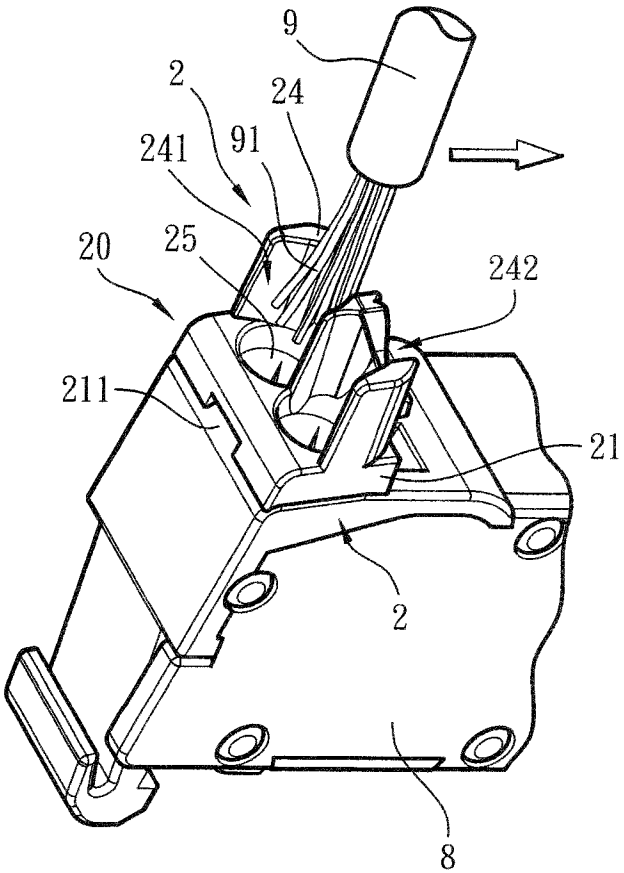
FIG. 20 is a perspective view of the tenth embodiment of the present invention, showing that a multi-strand conductive wire is to be plugged into the guide hole.
Figure 19:
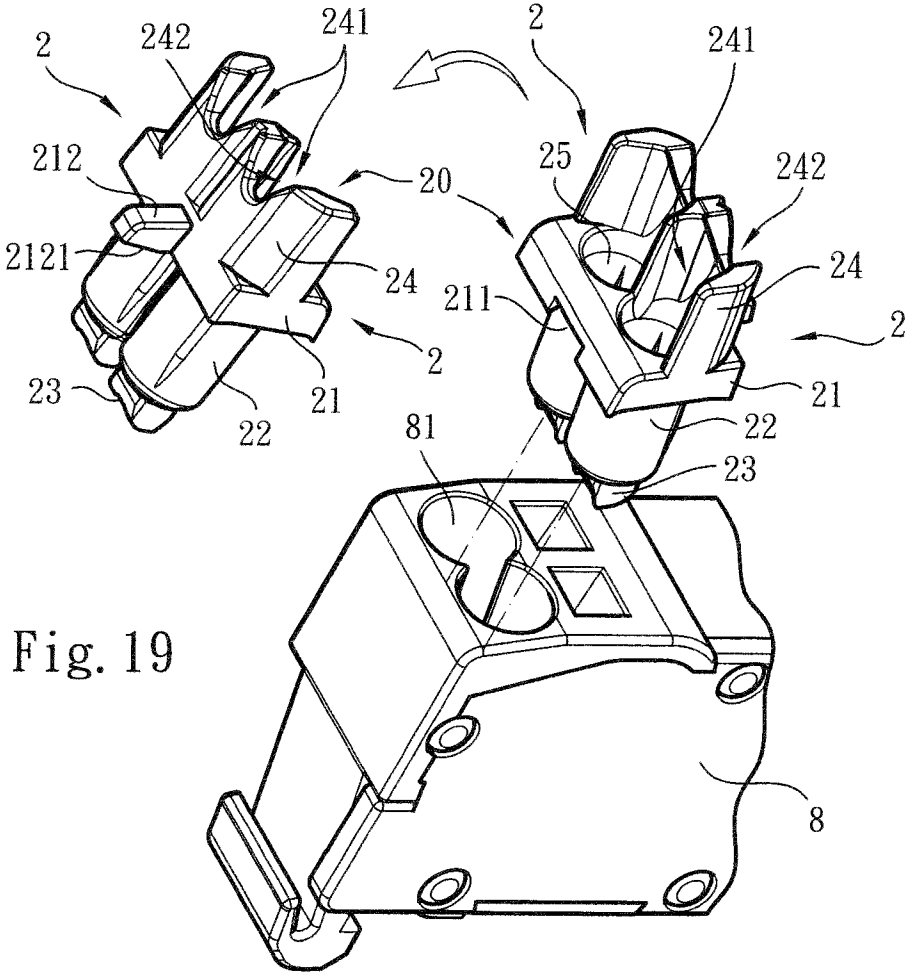
FIG. 19 is a perspective view of a tenth embodiment of the present invention.
Figure 22:
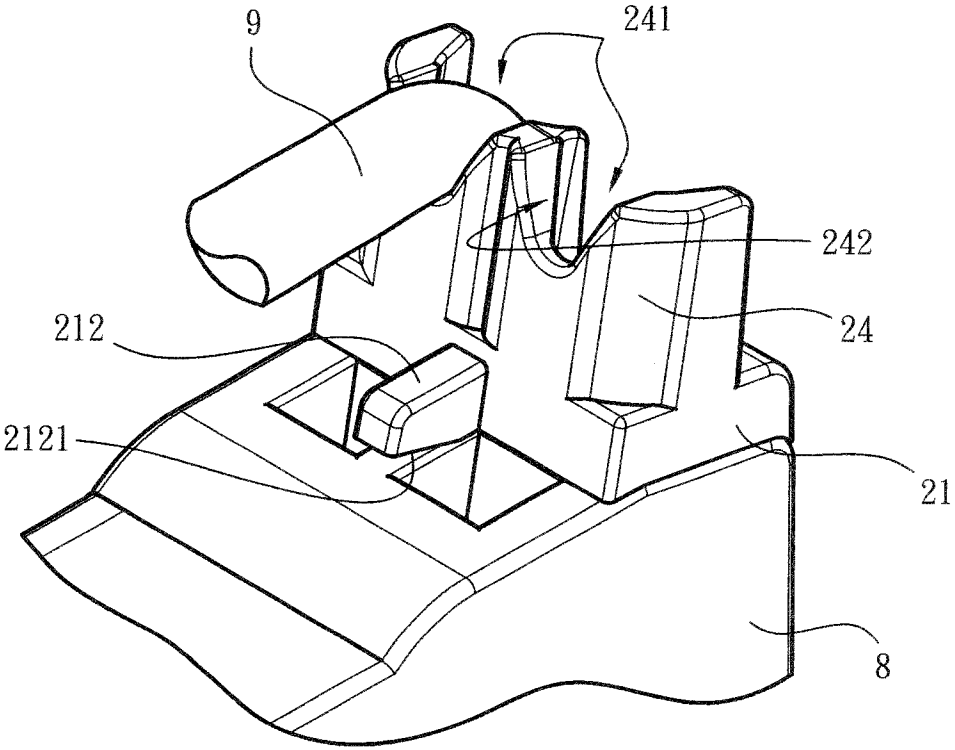
FIG. 22 is a perspective view showing the application of the tenth embodiment of the present invention.
Figure 21:
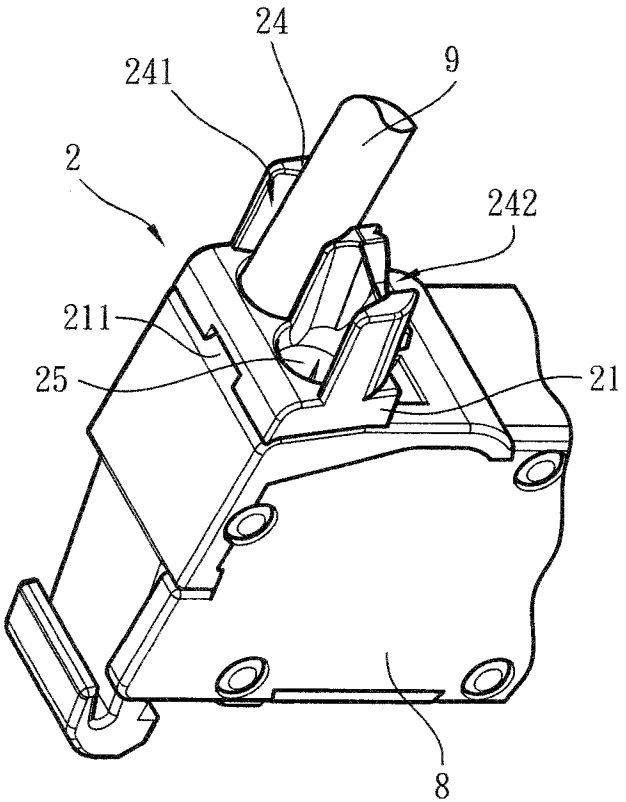
FIG. 21 is a perspective view of the tenth embodiment of the present invention, showing that the multi-strand conductive wire is plugged into the guide hole.

In use, the forked conductor end section 91 of the multi-strand conductive wire 9 can be transversely extended into the recessed guide channel 241 of the wire collection section 24. The recessed guide channel 241 serves to bind the forked conductor end section 91 (as shown in FIG. 20). Then the multi-strand conductive wire 9 is pushed into the guide hole 25, whereby the conductor end section 91 can be plugged into the wire inlet 81 of the terminal device 8 (as shown in FIG. 21) to electrically connect with an electro-conductive plate (not shown) preset in the terminal device 8. Finally, the multi-strand conductive wire 9 can be bent toward the middle of the terminal device 8 and inlaid in the corresponding depression section 242 and located therein (as shown in FIG. 22).

Figure 23:
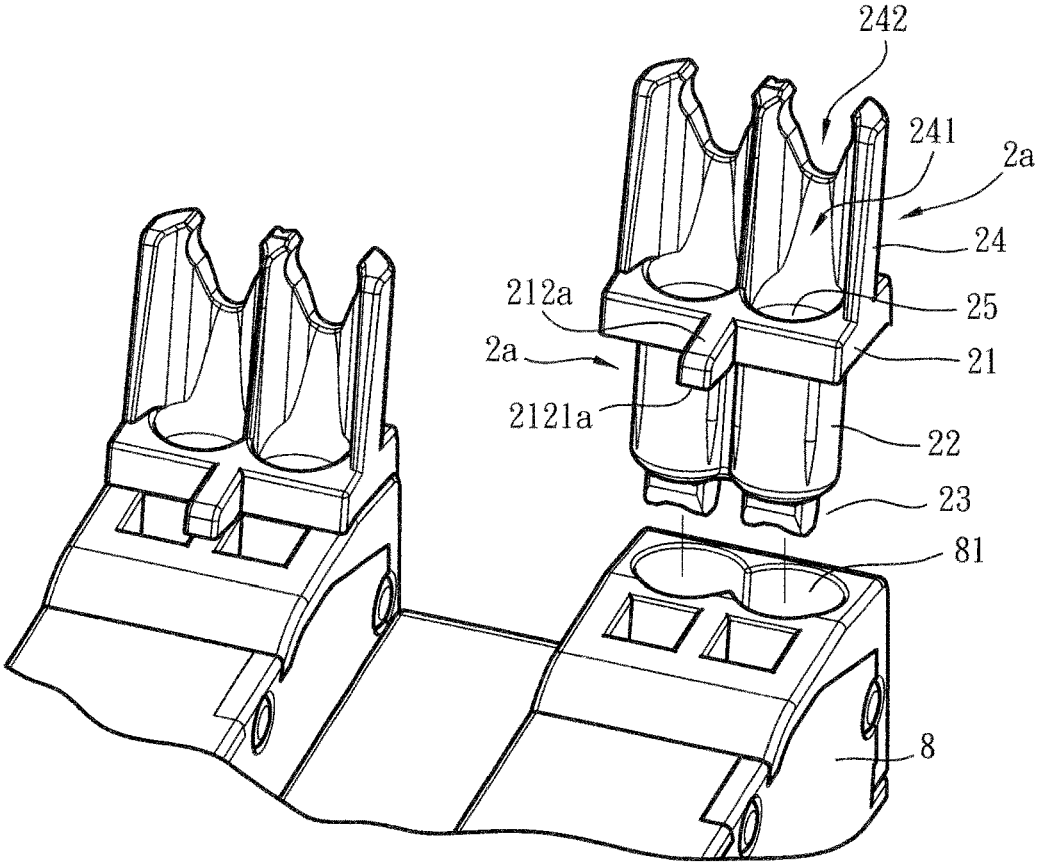
FIG. 23 is a perspective view of an eleventh embodiment of the present invention, showing the structure of the aid sleeve before the aid sleeve is assembled with a terminal device.
Figure 24:
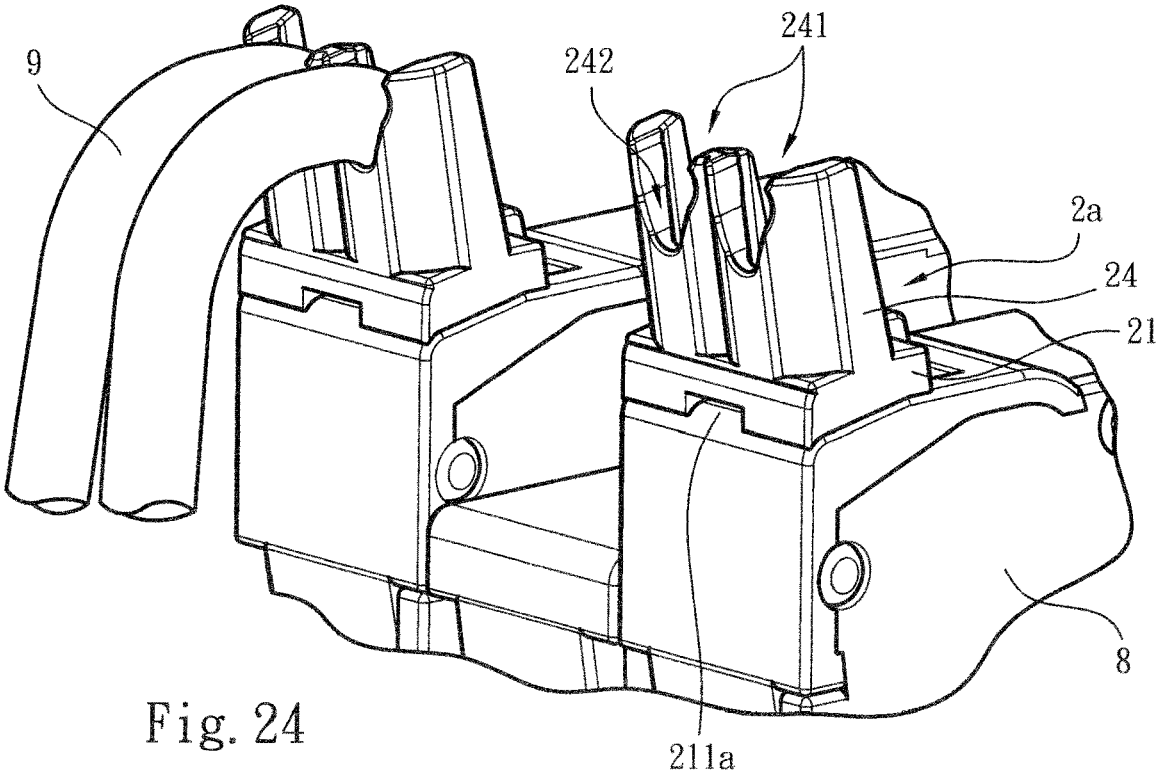
FIG. 24 is a perspective view showing the application of the eleventh embodiment of the present invention.

Please now refer to FIGS. 23 and 24. According to an eleventh embodiment, the wire plug-in aid sleeve structure for wire connection terminal of the present invention includes at least one aid sleeve 2*a*. The aid sleeve 2*a* has a head section 21, a middle section 22, a tail section 23, a wire collection section 24 and a guide hole 25 identical to those of the tenth embodiment. The aid sleeve 2*a* is different from the aid sleeve 2 in that a lateral protrusion 212*a* is transversely disposed on one side of the head section 21 of the aid sleeve 2*a* proximal to the recessed guide channel 241. One side of the lateral protrusion 212*a* proximal to the middle section 22 is formed with a lower slope 2121*a*. A notch 211*a* is formed on one side of the head section 21 distal from the lateral protrusion 212*a*. The function of the lateral protrusion 212*a* and the notch 211*a* is identical to that of the lateral protrusion 212 and the notch 211 and thus will not be redundantly described hereinafter.

In the above structure, two aid sleeves 2*a* are assembled with each other to form an aid sleeve assembly 20*a* in the same manner as the tenth embodiment. One side of the aid sleeve 2*a* of the aid sleeve assembly 20*a* with the lateral protrusion 212*a* is directed to the middle of the terminal device 8 and the tail section 23 and the middle section 22 are mounted in the wire inlet 81. Therefore, the conductor end section 91 of the multi-strand conductive wire 9 can be bound by the recessed guide channel 241 and plugged into the wire inlet 81 of the terminal device 8. Thereafter, the multi-strand conductive wire 9 can be bent toward two sides of the terminal device 8 and inlaid in the corresponding depression section 242 and located therein (as shown in FIG. 24).

Figure 25:
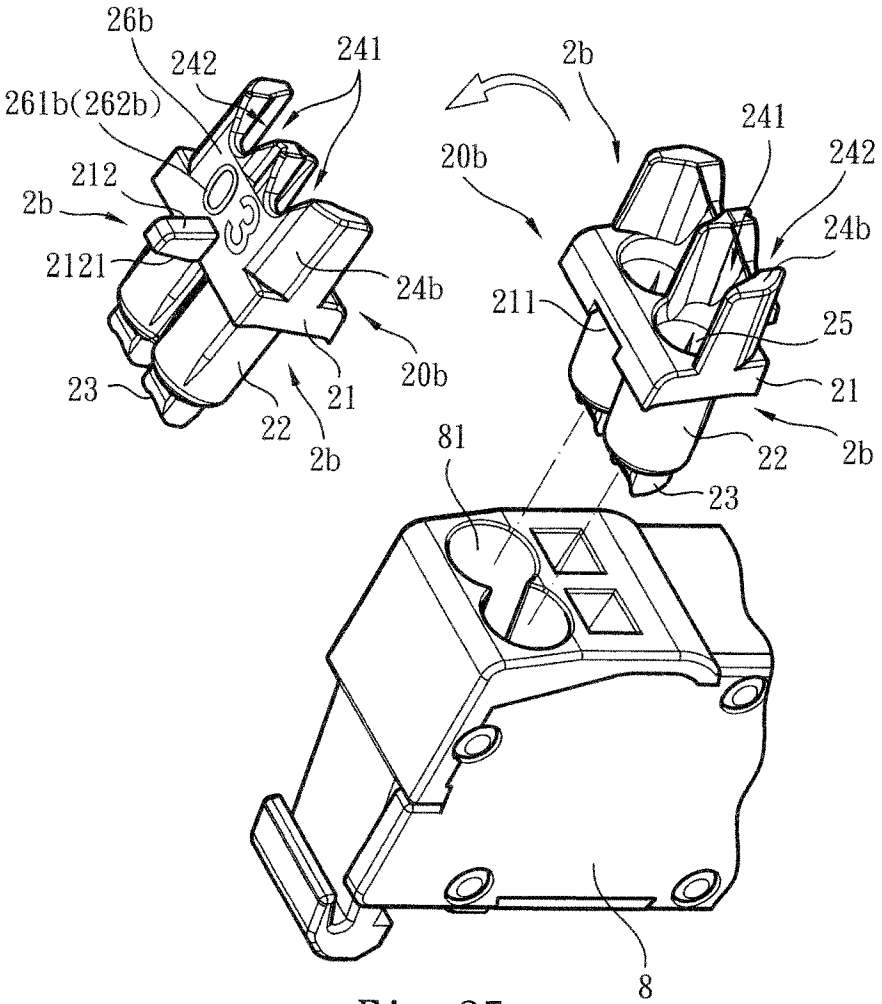
FIG. 25 is a perspective view of a twelfth embodiment of the present invention, showing the structure of the aid sleeve before the aid sleeve is assembled with a terminal device.

Please now refer to FIG. 25. According to a twelfth embodiment, the wire plug-in aid sleeve structure for wire connection terminal of the present invention includes at least one aid sleeve 2*b*. The aid sleeve 2*b* has a wire collection section 24*b* and a head section 21, a middle section 22, a tail section 23 and a guide hole 25 identical to those of the tenth embodiment. The wire collection section 24*b* has a recessed guide channel 241 and a depression section 242 similar to those of the wire collection section 24. Also, the wire collection section 24*b* is disposed on the head section 21 in the same manner as the wire collection section 24. The wire collection section 24*b* is simply different from the wire collection section 24 in that a display face 26*b* with a character encoding assembly 261*b* is disposed on one side of the wire collection section 24*b* distal from the recessed guide channel 241 (the guide hole 25).

In this embodiment, two aid sleeves 2*b* are assembled with each other to form an aid sleeve assembly 20*b* in the same manner as the tenth embodiment. The display face 26*b* is together disposed on one side of the two wire collection sections 24*b* distal from the recessed guide channel 241 (the guide hole 25). The character encoding assembly 261*b* is a character code 262*b* directly stamped on the display face 26*b*.

Figure 26:
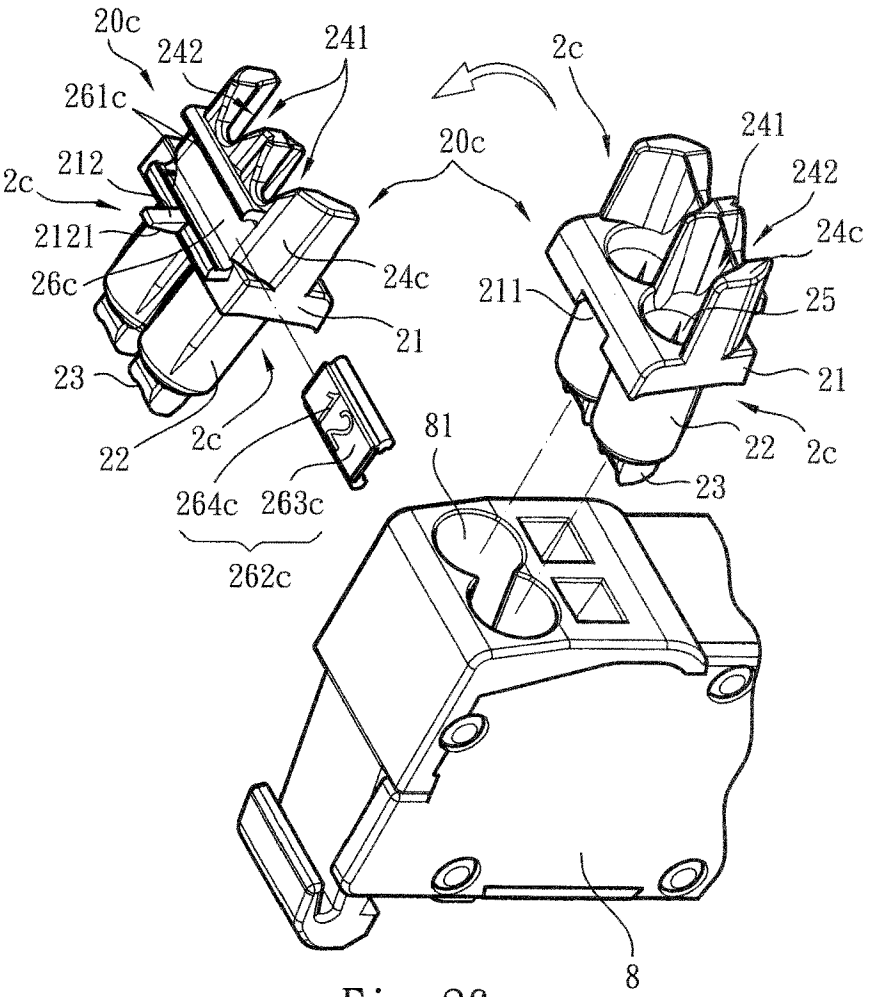
FIG. 26 is a perspective view of a thirteenth embodiment of the present invention, showing the structure of the aid sleeve before the aid sleeve is assembled with a terminal device.

Please now refer to FIG. 26. According to a thirteenth embodiment, the wire plug-in aid sleeve structure for wire connection terminal of the present invention includes at least one aid sleeve 2*c*. The aid sleeve 2*c* has a wire collection section 24*c* and a head section 21, a middle section 22, a tail section 23 and a guide hole 25 identical to those of the tenth embodiment. The wire collection section 24*c* has a recessed guide channel 241 and a depression section 242 similar to those of the wire collection section 24. Also, the wire collection section 24*c* is disposed on the head section 21 in the same manner as the wire collection section 24. The wire collection section 24*c* is simply different from the wire collection section 24 in that a display face 26*c* is disposed on one side of the wire collection section 24*c* distal from the recessed guide channel 241 (the guide hole 25). The display face 26*c* can be assembled with a character encoding assembly 262*c*.

In this embodiment, two aid sleeves 2*c* are assembled with each other to form an aid sleeve assembly 20*c* in the same manner as the tenth embodiment. The display face 26*c* is together disposed on one side of the two wire collection sections 24*c* distal from the recessed guide channel 241 (the guide hole 25). Two opposite sides of the display face 26*c* are respectively formed with a slide channel 261*c*. The character encoding assembly 262*c* is a display plate 263*c* stamped with a character code 264*c*. Two lateral sides of the display plate 263*c* can be respectively extended into the slide channels 261*c* to locate therein, whereby a replaceable encoding structure is formed.

Figure 27:
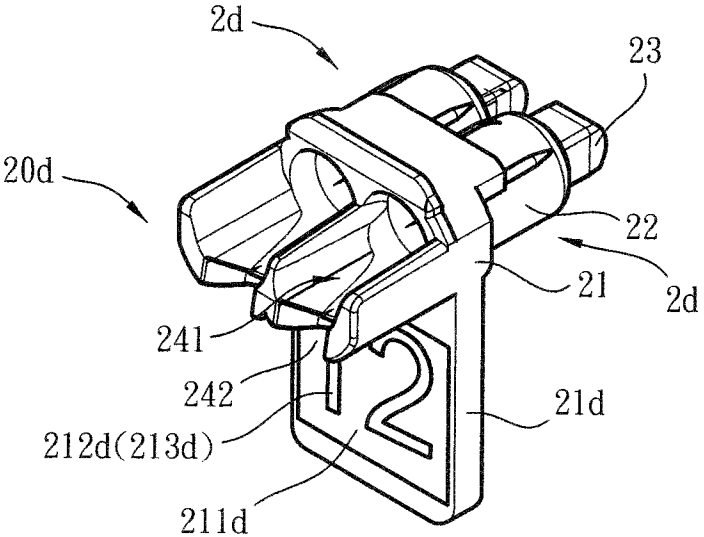
FIG. 27 is a perspective exploded view of a fourteenth embodiment of the present invention.

Please now refer to FIG. 27. According to a fourteenth embodiment, the wire plug-in aid sleeve structure for wire connection terminal of the present invention includes at least one aid sleeve 2*d*. The aid sleeve 2*d* has a head section 21, a middle section 22, a tail section 23, a wire collection section 24 and a guide hole 25 identical to those of the tenth embodiment. The fourteenth embodiment is simply different from the tenth embodiment in that a side wing section 21*d* is transversely disposed on one side of the head section 21 distal from the recessed guide channel 241 (the guide hole 25). A display face 211*d* with a character encoding assembly 212*d* is disposed on one side of the side wing section 21*d*.

In this embodiment, two aid sleeves 2*d* are assembled with each other to form an aid sleeve assembly 20*d* in the same manner as the tenth embodiment. The side wing section 21*d* is together disposed on one side of the two head sections 21 distal from the recessed guide channel 241 (the guide hole 25). The character encoding assembly 212*d* is a character code 213*d* directly stamped on the display face 211*d*.

Figure 28:
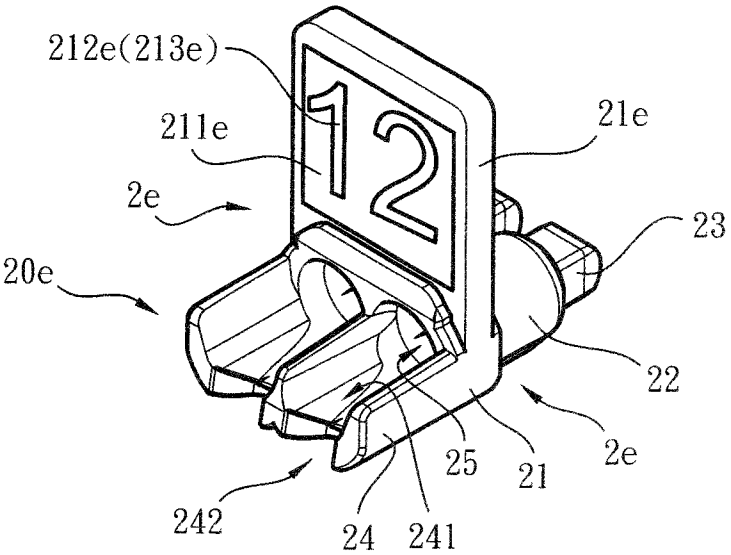
FIG. 28 is a perspective exploded view of a fifteenth embodiment of the present invention.

Please now refer to FIG. 28. According to a fifteenth embodiment, the wire plug-in aid sleeve structure for wire connection terminal of the present invention includes at least one aid sleeve 2*e*. The aid sleeve 2*e* has a head section 21, a middle section 22, a tail section 23, a wire collection section 24 and a guide hole 25 identical to those of the tenth embodiment. The fifteenth embodiment is simply different from the tenth embodiment in that a side wing section 21*e* is transversely disposed on one side of the head section 21 proximal to the recessed guide channel 241 (the guide hole 25). A display face 211*e* with a character encoding assembly 212*e* is disposed on one side of the side wing section 21*e*.

In this embodiment, two aid sleeves 2*e* are assembled with each other to form an aid sleeve assembly 20*e* in the same manner as the tenth embodiment. The side wing section 21*e* is together disposed on one side of the two head sections 21 proximal to the recessed guide channel 241 (the guide hole 25). The character encoding assembly 212*e* is a character code 213*e* directly stamped on the display face 211*e*.

Figure 29:
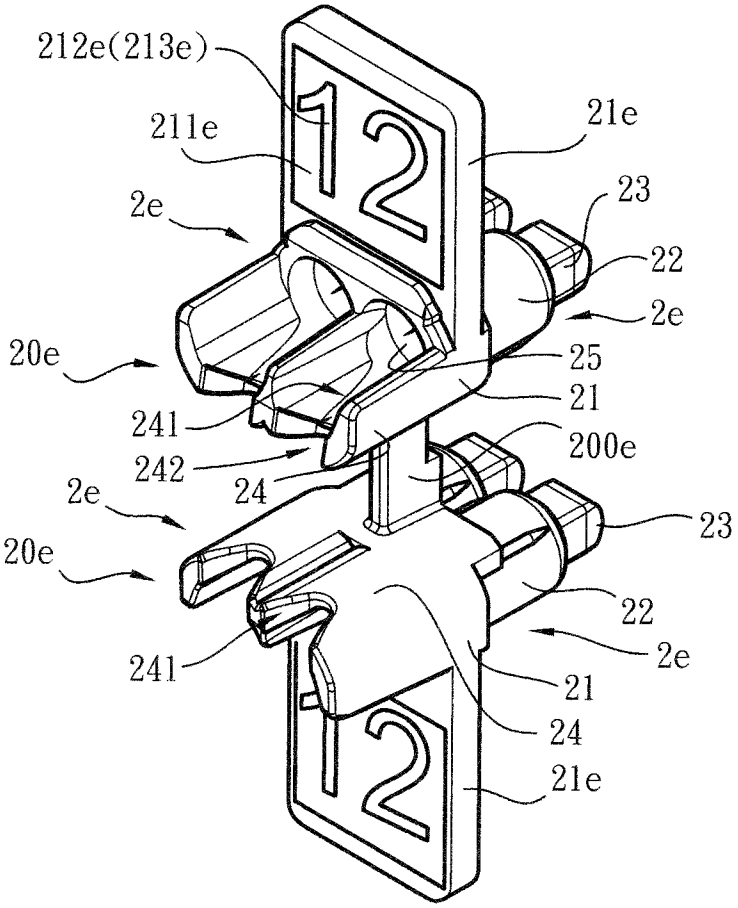
FIG. 29 is a perspective exploded view of a sixteenth embodiment of the present invention.

Please now refer to FIG. 29. According to a sixteenth embodiment, the wire plug-in aid sleeve structure for wire connection terminal of the present invention includes two aid sleeve assemblies 20*e*, which are side by side arranged. One side of one of the aid sleeve assemblies 20*e* distal from the recessed guide channel 241 (the guide hole 25) is opposite to one side of the other of the aid sleeve assemblies 20*e* distal from the recessed guide channel 241 (the guide hole 25). A connection section 200*e* is connected between the head sections 21 of the two aid sleeve assemblies 20*e*, whereby the two aid sleeve assemblies 20*e* are integrally connected with each other via the connection section 200*e*.

In practice, a structure similar to the connection section 200*d* can be used to integrally connect the two aid sleeve assemblies 20*d* of the fourteenth embodiment as shown in FIG. 27 in the same manner.

Figure 30:
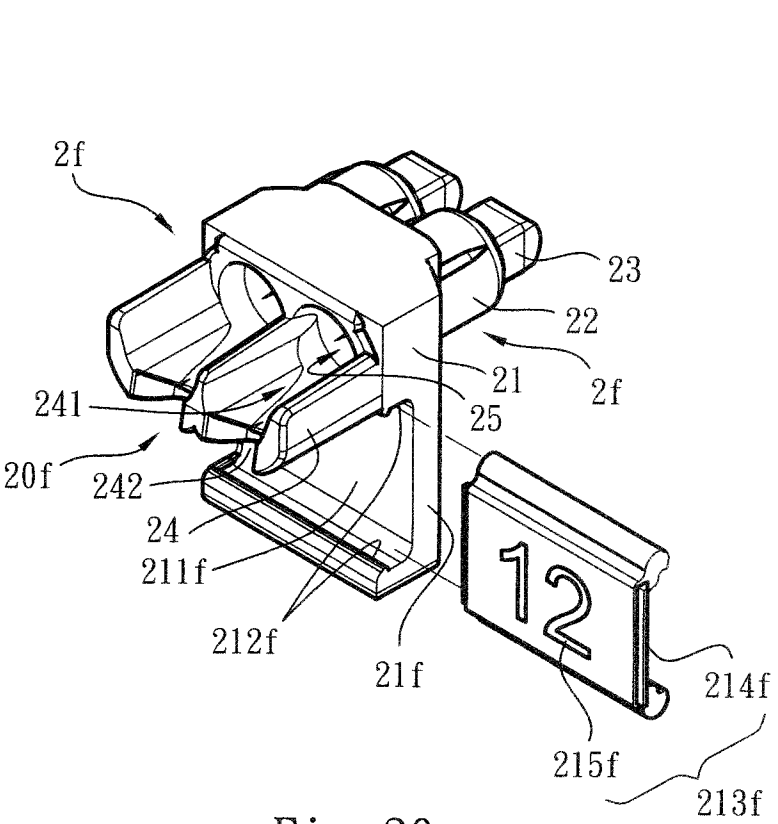
FIG. 30 is a perspective exploded view of a seventeenth embodiment of the present invention.

Please now refer to FIG. 30. According to a seventeenth embodiment, the wire plug-in aid sleeve structure for wire connection terminal of the present invention includes at least one aid sleeve 2*f*. The aid sleeve 2*f* has a head section 21, a middle section 22, a tail section 23, a wire collection section 24 and a guide hole 25 identical to those of the tenth embodiment. The seventeenth embodiment is simply different from the tenth embodiment in that a side wing section 21*f* is transversely disposed on one side of the head section 21 distal from the recessed guide channel 241 (the guide hole 25). A display face 211*f* with a character encoding assembly 213*f* is disposed on one side of the side wing section 21*f*.

In this embodiment, two aid sleeves 2*f* are assembled with each other to form an aid sleeve assembly 20*f* in the same manner as the tenth embodiment. The side wing section 21*f* is together disposed on one side of the two head sections 21 distal from the recessed guide channel 241 (the guide hole 25). Two opposite sides of the display face 211*f* are respectively formed with a slide channel 212*f*. The character encoding assembly 213*f* is a display plate 214*f* stamped with a character code 215*f*. Two lateral sides of the display plate 214*f* can be respectively extended into the slide channels 212*f* to locate therein, whereby a replaceable encoding structure is formed.

Figure 31:
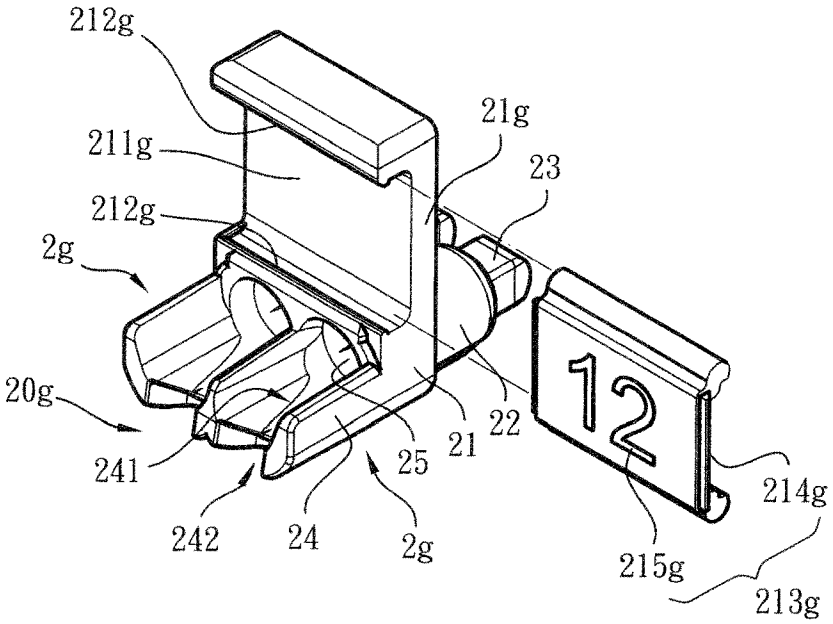
FIG. 31 is a perspective exploded view of an eighteenth embodiment of the present invention.

Please now refer to FIG. 31. According to an eighteenth embodiment, the wire plug-in aid sleeve structure for wire connection terminal of the present invention includes at least one aid sleeve 2*g*. The aid sleeve 2*g* has a head section 21, a middle section 22, a tail section 23, a wire collection section 24 and a guide hole 25 identical to those of the tenth embodiment. The eighteenth embodiment is simply different from the tenth embodiment in that a side wing section 21*g* is transversely disposed on one side of the head section 21 proximal to the recessed guide channel 241 (the guide hole 25). A display face 211*g* with a character encoding assembly 213*g* is disposed on one side of the side wing section 21*g*.

In this embodiment, two aid sleeves 2*g* are assembled with each other to form an aid sleeve assembly 20*g* in the same manner as the tenth embodiment. The side wing section 21*g* is together disposed on one side of the two head sections 21 proximal to the recessed guide channel 241 (the guide hole 25). Two opposite sides of the display face 211*g* are respectively formed with a slide channel 212*g*. The character encoding assembly 213*g* is a display plate 214*g* stamped with a character code 215*g*. Two lateral sides of the display plate 214*g* can be respectively extended into the slide channels 212*g* to locate therein, whereby a replaceable encoding structure is formed.

Figure 32:
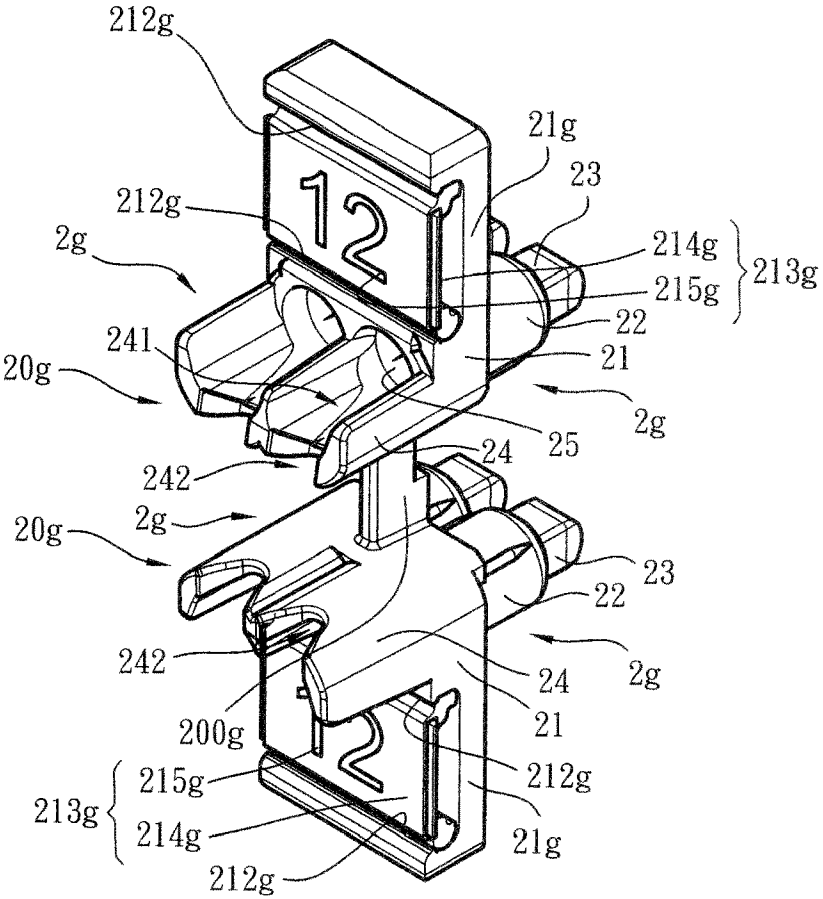
FIG. 32 is a perspective exploded view of a nineteenth embodiment of the present invention.

Please now refer to FIG. 32. According to a nineteenth embodiment, the wire plug-in aid sleeve structure for wire connection terminal of the present invention includes two aid sleeve assemblies 20*g*, which are side by side arranged. One side of one of the aid sleeve assemblies 20*g* distal from the recessed guide channel 241 (the guide hole 25) is opposite to one side of the other of the aid sleeve assemblies 20*g* distal from the recessed guide channel 241 (the guide hole 25). A connection section 200*g* is connected between the head sections 21 of the two aid sleeve assemblies 20*g*, whereby the two aid sleeve assemblies 20*g* are integrally connected with each other via the connection section 200*g*.

In practice, a structure similar to the connection section 200*g* can be used to integrally connect the two aid sleeve assemblies 20*f* of the seventeenth embodiment as shown in FIG. 30 in the same manner.

In conclusion, the wire plug-in aid sleeve structure for wire connection terminal of the present invention can easily bind the multi-strand conductive wire and conveniently plug the multi-strand conductive wire into the wire inlet of the terminal. The present invention is truly inventive and advanced.

The above embodiments are only used to illustrate the present invention, not intended to limit the scope thereof. Many modifications of the above embodiments can be made without departing from the spirit of the present invention.

What is claimed is:

1. A wire plug-in aid sleeve structure for wire connection terminal, comprising at least one aid sleeve assembly composed of at least one aid sleeve, the aid sleeve being formed with a head section having an internal guide hole extending longitudinally therethrough and through distal portions of the aid sleeve, the aid sleeve having a wire collection section extending longitudinally from a proximal side of the head section to a proximal perimeter of the aid sleeve, a recessed guide channel being disposed on one side of the wire collection section proximal to the guide hole and being in open communication with the guide hole.

2. The wire plug-in aid sleeve structure for wire connection terminal as claimed in claim 1, wherein the recessed guide channel includes two lateral outer arched channels with larger curvature radius, the two lateral outer arched channels gradually extending toward a middle bottom face to form an inner arched channel with smaller curvature radius.

3. The wire plug-in aid sleeve structure for wire connection terminal as claimed in claim 2, wherein the distal portions of the aid sleeve include a tail section at a distal end thereof and a middle section connected between the head section and the tail section, the guide hole being tapered at the junction between the middle section and the tail section, the tail section protruding from the middle section, the middle section having a cross-sectional area larger than that of the tail section, the tail section having two lateral sides positioned on a periphery of the guide hole, the two lateral sides defining therebetween a notch, the aid sleeve assembly being composed of multiple aid sleeves, which are side by side arranged, the head sections of the aid sleeves being connected to form the aid sleeve assembly.

4. The wire plug-in aid sleeve structure for wire connection terminal as claimed in claim 3, wherein one side of the head section is formed with a notch proximal to the middle section, the head section having a lateral protrusion transversely protruding from the head section, one side of the lateral protrusion proximal to the middle section being formed with a lower slope.

5. The wire plug-in aid sleeve structure for wire connection terminal as claimed in claim 4, wherein a display face with a character encoding assembly is disposed on one side of the wire collection section distal from the recessed guide channel, the character encoding assembly being a character code directly stamped on the display face.

6. The wire plug-in aid sleeve structure for wire connection terminal as claimed in claim 5, wherein there are at least two aid sleeve assemblies, a connection section being disposed between the aid sleeve assemblies, the connection section being connected between the head sections of the aid sleeves of the aid sleeve assemblies.

7. The wire plug-in aid sleeve structure for wire connection terminal as claimed in claim 4, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

8. The wire plug-in aid sleeve structure for wire connection terminal as claimed in claim 4, wherein at least one side wing section is transversely disposed on one side of the head section, a display face with a character encoding assembly being disposed on at least one side of the side wing section, the character encoding assembly being a character code directly stamped on the display face.

9. The wire plug-in aid sleeve structure for wire connection terminal as claimed in claim 3, wherein a display face with a character encoding assembly is disposed on one side of the wire collection section distal from the recessed guide channel, the character encoding assembly being a character code directly stamped on the display face.

10. The wire plug-in aid sleeve structure for wire connection terminal as claimed in claim 9, wherein there are at least two aid sleeve assemblies, a connection section being disposed between the aid sleeve assemblies, the connection section being connected between the head sections of the aid sleeves of the aid sleeve assemblies.

11. The wire plug-in aid sleeve structure for wire connection terminal as claimed in claim 3, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

12. The wire plug-in aid sleeve structure for wire connection terminal as claimed in claim 11, wherein there are at least two aid sleeve assemblies, a connection section being disposed between the aid sleeve assemblies, the connection section being connected between the head sections of the aid sleeves of the aid sleeve assemblies.

13. The wire plug-in aid sleeve structure for wire connection terminal as claimed in claim 3, wherein at least one side wing section is transversely disposed on one side of the head section, a display face with a character encoding assembly being disposed on at least one side of the side wing section, the character encoding assembly being a character code directly stamped on the display face.

14. The wire plug-in aid sleeve structure for wire connection terminal as claimed in claim 3, wherein at least one side wing section is transversely disposed on one side of the head section, a display face with a character encoding assembly being disposed on at least one side of the side wing section, two opposite sides of the display face being respectively formed with a slide channel, the character encoding assembly being a display plate having a character code, two lateral sides of the display plate being respectively extended into the slide channels to locate therein.

15. The wire plug-in aid sleeve structure for wire connection terminal as claimed in claim 2, wherein a display face with a character encoding assembly is disposed on one side of the wire collection section distal from the recessed guide channel, the character encoding assembly being a character code directly stamped on the display face.

16. The wire plug-in aid sleeve structure for wire connection terminal as claimed in claim 2, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

17. The wire plug-in aid sleeve structure for wire connection terminal as claimed in claim 1, wherein a depression section is formed at one end of the wire collection section distal from the guide hole.

18. The wire plug-in aid sleeve structure for wire connection terminal as claimed in claim 17, wherein the aid sleeve has a head section and a tail section at two ends and a middle section connected between the head section and the tail section, the guide hole being tapered at the junction between the middle section and the tail section, the tail section protruding from the middle section, the middle section having a cross-sectional area larger than that of the tail section, the tail section having two lateral sides positioned on a periphery of the guide hole, the two lateral sides defining therebetween a notch, the aid sleeve assembly being composed of multiple aid sleeves, which are side by side arranged, the head sections of the aid sleeves being connected to form the aid sleeve assembly.

19. The wire plug-in aid sleeve structure for wire connection terminal as claimed in claim 18, wherein one side of the head section is formed with a notch proximal to the middle section, the head section having a lateral protrusion transversely protruding from the head section, one side of the lateral protrusion proximal to the middle section being formed with a lower slope.

20. The wire plug-in aid sleeve structure for wire connection terminal as claimed in claim 19, wherein at least one side wing section is transversely disposed on one side of the head section, a display face with a character encoding assembly being disposed on at least one side of the side wing section, the character encoding assembly being a character code directly stamped on the display face.

21. The wire plug-in aid sleeve structure for wire connection terminal as claimed in claim 18, wherein at least one side wing section is transversely disposed on one side of the head section, a display face with a character encoding assembly being disposed on at least one side of the side wing section, the character encoding assembly being a character code directly stamped on the display face.

22. The wire plug-in aid sleeve structure for wire connection terminal as claimed in claim 18, wherein at least one side wing section is transversely disposed on one side of the head section, a display face with a character encoding assembly being disposed on at least one side of the side wing section, two opposite sides of the display face being respectively formed with a slide channel, the character encoding assembly being a display plate having a character code, two lateral sides of the display plate being respectively extended into the slide channels to locate therein.

23. The wire plug-in aid sleeve structure for wire connection terminal as claimed in claim 17, wherein a display face with a character encoding assembly is disposed on one side of the wire collection section distal from the recessed guide channel, the character encoding assembly being a character code directly stamped on the display face.

24. The wire plug-in aid sleeve structure for wire connection terminal as claimed in claim 17, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

25. The wire plug-in aid sleeve structure for wire connection terminal as claimed in claim 1, wherein the distal portions of the aid sleeve include a tail section at a distal end thereof and a middle section connected between the head section and the tail section, the guide hole being tapered at the junction between the middle section and the tail section, the tail section protruding from the middle section, the middle section having a cross-sectional area larger than that of the tail section, the tail section having two lateral sides positioned on a periphery of the guide hole, the two lateral sides defining therebetween a notch, the aid sleeve assembly being composed of multiple aid sleeves, which are side by side arranged, the head sections of the aid sleeves being connected to form the aid sleeve assembly.

26. The wire plug-in aid sleeve structure for wire connection terminal as claimed in claim 25, wherein one side of the head section is formed with a notch proximal to the middle section, the head section having a lateral protrusion transversely protruding from the head section, one side of the lateral protrusion proximal to the middle section being formed with a lower slope.

27. The wire plug-in aid sleeve structure for wire connection terminal as claimed in claim 26, wherein a display face with a character encoding assembly is disposed on one side of the wire collection section distal from the recessed guide channel, the character encoding assembly being a character code directly stamped on the display face.

28. The wire plug-in aid sleeve structure for wire connection terminal as claimed in claim 26, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

29. The wire plug-in aid sleeve structure for wire connection terminal as claimed in claim 26, wherein at least one side wing section is transversely disposed on one side of the head section, a display face with a character encoding assembly being disposed on at least one side of the side wing section, the character encoding assembly being a character code directly stamped on the display face.

30. The wire plug-in aid sleeve structure for wire connection terminal as claimed in claim 25, wherein a display face with a character encoding assembly is disposed on one side of the wire collection section distal from the recessed guide channel, the character encoding assembly being a character code directly stamped on the display face.

31. The wire plug-in aid sleeve structure for wire connection terminal as claimed in claim 30, wherein there are at least two aid sleeve assemblies, a connection section being disposed between the aid sleeve assemblies, the connection section being connected between the head sections of the aid sleeves of the aid sleeve assemblies.

32. The wire plug-in aid sleeve structure for wire connection terminal as claimed in claim 25, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

33. The wire plug-in aid sleeve structure for wire connection terminal as claimed in claim 25, wherein at least one side wing section is transversely disposed on one side of the head section, a display face with a character encoding assembly being disposed on at least one side of the side wing section, the character encoding assembly being a character code directly stamped on the display face.

34. The wire plug-in aid sleeve structure for wire connection terminal as claimed in claim 25, wherein at least one side wing section is transversely disposed on one side of the head section, a display face with a character encoding assembly being disposed on at least one side of the side wing section, two opposite sides of the display face being respectively formed with a slide channel, the character encoding assembly being a display plate having a character code, two lateral sides of the display plate being respectively extended into the slide channels to locate therein.

35. The wire plug-in aid sleeve structure for wire connection terminal as claimed in claim 1, wherein a display face with a character encoding assembly is disposed on one side of the wire collection section distal from the recessed guide channel, the character encoding assembly being a character code directly stamped on the display face.

36. The wire plug-in aid sleeve structure for wire connection terminal as claimed in claim 1, wherein a display face with a character encoding assembly is disposed on one side of the wire collection section distal from the recessed guide channel, two opposite sides of the display face being respectively formed with a slide channel, the character encoding assembly being a display plate stamped with a character code, two lateral sides of the display plate being respectively extended into the slide channels to locate therein.

* * * * *